US008413974B2

(12) United States Patent
Shibasaki et al.

(10) Patent No.: US 8,413,974 B2
(45) Date of Patent: Apr. 9, 2013

(54) CREASING DEVICE AND IMAGE FORMING SYSTEM

(75) Inventors: Yuusuke Shibasaki, Kanagawa (JP); Naohiro Kikkawa, Kanagawa (JP); Hitoshi Hattori, Tokyo (JP); Shuuya Nagasako, Kanagawa (JP); Takashi Saito, Kanagawa (JP); Naoyuki Ishikawa, Kanagawa (JP); Hidetoshi Kojima, Miyagi (JP); Naoki Oikawa, Miyagi (JP); Go Aiba, Miyagi (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 13/067,206

(22) Filed: May 17, 2011

(65) Prior Publication Data

US 2011/0301008 A1 Dec. 8, 2011

(30) Foreign Application Priority Data

Jun. 8, 2010 (JP) ..... 2010-131103

(51) Int. Cl.
*B31F 1/08* (2006.01)

(52) U.S. Cl.
USPC ..... 270/32; 270/45; 270/58.07

(58) Field of Classification Search ..... 270/32, 270/37, 45, 46, 58.07; 493/59, 355, 396, 493/397, 240, 242
See application file for complete search history.

(56) References Cited

U.S. PATENT DOCUMENTS

| | | | | |
|---|---|---|---|---|
| 6,991,224 | B2 * | 1/2006 | Trovinger et al. | 270/32 |
| 7,416,177 | B2 | 8/2008 | Suzuki et al. | |
| 7,740,238 | B2 * | 6/2010 | Iijima et al. | 270/37 |
| 7,744,076 | B2 | 6/2010 | Suzuki et al. | |
| 7,770,876 | B2 * | 8/2010 | Sasahara | 270/32 |
| 7,913,988 | B2 * | 3/2011 | Awano | 270/45 |
| 2007/0056423 | A1 * | 3/2007 | Yamada et al. | 83/651 |
| 2008/0284092 | A1 | 11/2008 | Suzuki et al. | |
| 2009/0062096 | A1 * | 3/2009 | Sasahara | 493/396 |
| 2009/0181840 | A1 | 7/2009 | Awano | |
| 2009/0200724 | A1 * | 8/2009 | Iguchi et al. | 270/8 |
| 2010/0258994 | A1 | 10/2010 | Kikkawa et al. | |
| 2011/0064541 | A1 | 3/2011 | Kikkawa et al. | |

FOREIGN PATENT DOCUMENTS

| | | |
|---|---|---|
| JP | 2009166928 A | 7/2009 |
| JP | 2011057438 A | 3/2011 |
| WO | WO 03/024853 | 3/2003 |

OTHER PUBLICATIONS

English Abstract of JP 2011-057436 published Mar. 24, 2011.
European Search Report dated Sep. 16, 2011 issued in corresponding European Application No. 11250544.1.
English Abstract of JP 2011-057438 published Mar. 24, 2011.

* cited by examiner

*Primary Examiner* — Leslie A Nicholson, III
(74) *Attorney, Agent, or Firm* — Harness, Dickey & Pierce, P.L.C.

(57) ABSTRACT

A creasing device for creasing sheets on a per-sheet basis, the creasing device includes: a first member extending perpendicularly to a sheet conveying direction and including a male blade, which has a convex cross section; a second member extending perpendicularly to the sheet conveying direction and including a grooved female blade, into which the male blade to be fitted with a sheet between the female blade and the male blade; and a drive unit that brings the first member and the second member relatively into and out of contact with each other to cause a sheet stopped at a predetermined position to be pinched between the first member and the second member and creased. An edge portion of any one of the first member and the second member has an arcuate shape.

8 Claims, 23 Drawing Sheets

CREASING DEVICE AND IMAGE FORMING SYSTEM

CROSS-REFERENCE TO RELATED APPLICATIONS

The present application claims priority to and incorporates by reference the entire contents of Japanese Patent Application No. 2010-131103 filed in Japan on Jun. 8, 2010.

BACKGROUND OF THE INVENTION

1. Field of the Invention

The present invention relates to a creasing device and an image forming system.

2. Description of the Related Art

What is called saddle-stitched or center-folded booklet production has been conventionally performed. The saddle-stitched booklet production is performed by saddle stitching a sheet batch, which is a stack of a plurality of sheets delivered from an image forming apparatus, and folding the thus-saddle-stitched sheet batch in the middle of the sheet batch. Folding such a sheet batch containing a plurality of sheets can cause outside sheets of the sheet batch to be stretched at a fold line by a greater amount than inside sheets. Image portions at the fold line on outside sheets can thus be stretched, resulting in damage, such as come off of toner, to the image portions in some cases. A similar phenomenon can occur when other fold, such as z-fold or tri-fold, is performed. A sheet batch can be folded insufficiently depending on the thickness of the sheet batch.

Creasing devices that crease (score) a sheet batch prior to a folding process where the sheet batch undergoes half fold or the like to make outside sheets easy to fold, thereby preventing come off of toner have already been known. Some type of such creasing devices produce a crease in a sheet in a direction perpendicular to a sheet conveying direction by moving a roller on a sheet, burning a sheet with a laser beam, pressing a creasing blade against a sheet, or a like method.

A known example of such a creasing device is disclosed in Japanese Patent Application Laid-open No. 2009-166928. A technique of moving a creasing member by using a plurality of individually-advancing-and-retracting mechanisms, which are activated at different times, so that the creasing member presses a sheet with a gradually-decreasing pressure to produce a crease is disclosed in Japanese Patent Application Laid-open No. 2009-166928.

However, producing a crease in a sheet with a roller involves moving the roller across a length of the sheet in a direction, along which a fold extends, and therefore is time consuming. This can be resolved by rotating the sheet conveying direction by 90 degrees and producing a crease parallel to the sheet conveying direction; however, this scheme involves a change in footprint and therefore is disadvantageous for space-saving design. Creasing by using a laser beam is environmentally less favorable because smoke and odor are given off during creasing.

Creasing a sheet by pressing a creasing blade against the sheet can be performed in a relatively short period of time and allows easy production of a crease perpendicular to a sheet conveying direction; however, pressing a longitudinal face of the creasing blade against the sheet entirely at once can increase a load. To reduce the load, a scheme of virtually dividing the face of the creasing blade into a plurality of portions and bringing the creasing blade face into contact with a sheet a plurality of times, one portion each time, can be used. However, this scheme is disadvantageous in that unevenness can develop between a portion that contacts the blade multiple times and a portion that contacts the blade only once and also in that producing a crease by making contact multiple times can decrease productivity.

To solve the inconveniences discussed above, it is possible to reduce a load placed on a creasing moving unit by bringing a creasing blade gradually into contact with a sheet from an edge of the sheet and causing a creasing unit to contact the sheet only once; however, this causes a pressure applied onto a center portion of the sheet to be weakened, making it difficult to produce an even crease.

SUMMARY OF THE INVENTION

It is an object of the present invention to at least partially solve the problems in the conventional technology.

According to an aspect of the present invention, there is provided a creasing device for creasing sheets on a per-sheet basis, the creasing device including: a first member extending in a direction perpendicular to a sheet conveying direction and including a male blade, the male blade having a convex cross section; a second member extending in the direction perpendicular to the sheet conveying direction and including a grooved female blade, the female blade allowing the male blade to be fitted thereinto with a sheet between the female blade and the male blade; and a drive unit that brings the first member and the second member relatively into and out of contact with each other to cause a sheet stopped at a predetermined position to be pinched between the first member and the second member and creased, wherein an edge portion of any one member of the first member and the second member has an arcuate shape.

According to another aspect of the present invention, there is provided an image forming system including a creasing device; and an image forming apparatus for forming an image on a sheet member, wherein the creasing device includes: a first member extending in a direction perpendicular to a sheet conveying direction and including a male blade, the male blade having a convex cross section; a second member extending in the direction perpendicular to the sheet conveying direction and including a grooved female blade, the female blade allowing the male blade to be fitted thereinto with a sheet between the female blade and the male blade; and a drive unit that brings the first member and the second member relatively into and out of contact with each other to cause a sheet stopped at a predetermined position to be pinched between the first member and the second member and creased, wherein an edge portion of any one member of the first member and the second member has an arcuate shape.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

According to an aspect of the present invention, distal-end portions of a male blade, which is a creasing blade for use in creasing a sheet before the sheet is folded, and a female blade are arcuate in shape in a longitudinal direction of the blades so that the creasing blade can make a point-to-point contact with the sheet. This reduces a driving load for creasing, thereby allowing a uniform crease to be produced by a single stroke of contact. In the embodiments discussed below, a reference symbol A corresponds to the creasing unit; a creasing blade 6-1 is an example of the male blade; a creasing member 6 is an example of the first member; a creasing channel 7*a* is an example of the female blade; a receiving member 7 is an example of the second member; a drive mechanism 40 is an example of the drive unit, a CPU A1 is an example of the control unit; a reference symbol F corresponds to the image forming apparatus.

Exemplary embodiments of the present invention are described in detail below with reference to the accompanying drawings.

Figure 1:
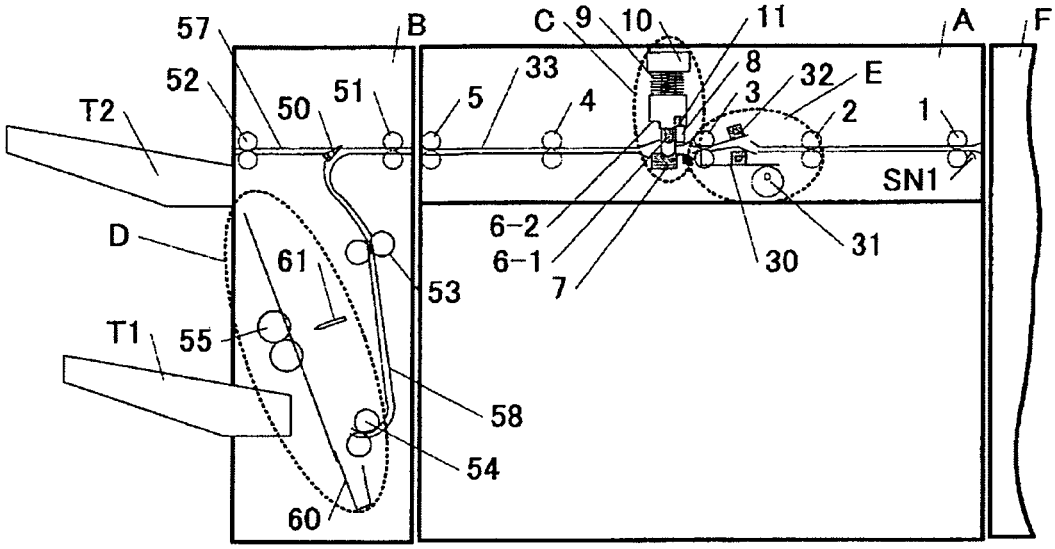
FIG. 1 is a diagram illustrating a schematic configuration of an image forming system according to an embodiment of the present invention.

FIG. 1 is a diagram illustrating a schematic configuration of an image forming system according to an embodiment of the present invention. The image forming system according to the embodiment includes the image forming apparatus F that forms an image on a sheet of paper (hereinafter, "sheet"), the creasing device A that creases the sheet, and a folding device B folds the sheet at a predetermined position.

The image forming apparatus F forms a visible image pertaining to image data fed from a scanner, a personal computer (PC), or the like on a sheet of paper. The image forming apparatus F uses a known print engine of electrophotography, droplet ejection printing, or the like.

The creasing device A includes a conveyance path 33, first to fifth conveying rollers 1 to 5 located in this order along a forward sheet conveying direction of the conveyance path 33, an entrance sensor SN1 provided upstream of the first conveying rollers 1 at an entrance of the device for detection of a sheet, a creasing unit C provided between the third and the fourth conveying rollers 3 and 4, and a skew correcting unit E in an immediate vicinity of the creasing unit C relative to the sheet conveying direction. The creasing unit C includes the creasing blade 6-1, a creasing support member 6-2, the receiving member 7, a sheet retaining member 8, a resilient member (for example, spring) 9 that applies a pressure to the creasing blade 6-1, a resilient member fixing plate 10, and a resilient member 11 that applies a pressure to the sheet retaining member 8. The skew correcting unit E includes a stopper plate 30, a stopper-plate cam 31, and a conveyance guide plate 32. The creasing blade 6-1 and the receiving member 7 pinch a sheet therebetween to produce a crease facing the creasing blade 6-1 at its inner side.

The folding device B includes a sheet-output conveyance path 57, a processing conveyance path 58, sixth to ninth conveying rollers 51 to 54, and a folding unit D. The folding unit D includes a trailing-edge fence 60, folding rollers 55, a folding plate 61, and a first stacking tray T1 and a second stacking tray T2. A path-switching flap 50 for use in switching conveyance between the sheet-output conveyance path 57 and the processing conveyance path 58 is provided at a branching portion into the sheet-output conveyance path 57 and the processing conveyance path 58. The seventh conveying rollers 52 serving as sheet output rollers are provided most downstream of the sheet-output conveyance path 57.

Basic sheet conveyance operations to be performed in the image forming system illustrated in FIG. 1, from a step of receiving a sheet delivered from the image forming apparatus F to a step of delivering and stacking the sheet onto the stacking tray T1 or T2 are described below.

1) A sheet P delivered from the image forming apparatus F into the creasing device A passes by the entrance sensor SN1. Subsequently, the first to the fifth conveying rollers 1 to 5 start rotating based on detection information output from the entrance sensor SN1, and the first and the second conveying rollers 1 and 2 convey the sheet P to the skew correcting unit E.

The skew correcting unit E performs operations differently depending on whether skew correction is to be performed.

1-1) Situation where Skew Correction is to be Skipped

Figure 2:
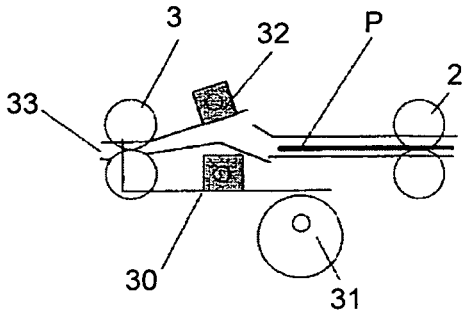
FIG. 2 is a schematic explanatory diagram of operations to be performed by a skew correcting unit in a situation where skew correction is to be skipped and illustrating a state where a leading edge of a sheet is immediately upstream of a stopper plate.
Figure 3:
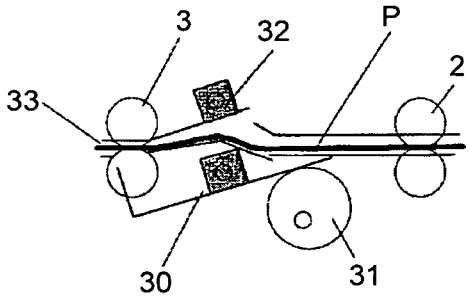
FIG. 3 is a schematic explanatory diagram of the operations to be performed by the skew correcting unit in the situation where skew correction is to be skipped and illustrating a state where the leading edge of the sheet has passed over the stopper plate.

FIG. 2 and FIG. 3 are schematic diagrams illustrating operations in a situation where skew correction is to be skipped. In the situation where skew correction is to be skipped, after the sheet P has been conveyed to the second conveying rollers 2 as illustrated in FIG. 2, the stopper-plate cam 31 rotates, causing the stopper plate 30 to retract from the conveyance path 33 as illustrated in FIG. 3. Thereafter, the sheet P is conveyed to the third conveying rollers 3 and then further conveyed toward the folding unit D downstream. During the conveyance, a conveyance speed of the second conveying rollers 2 and that of the third conveying rollers 3 are equal to each other.

1-2) Situation where Skew Correction is to be Performed

Figure 4:
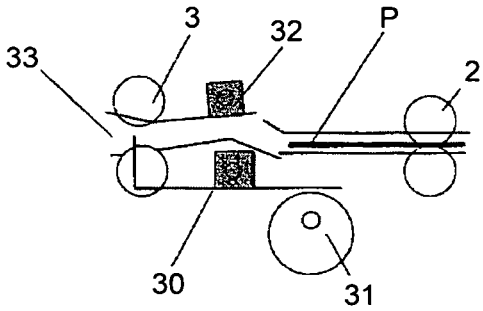
FIG. 4 is a schematic explanatory diagram of operations to be performed by the skew correcting unit in a situation where skew correction is to be performed and illustrating a state where a leading edge of a sheet is immediately upstream of the stopper plate and third conveying rollers are not pressing against each other and at standby.
Figure 5:
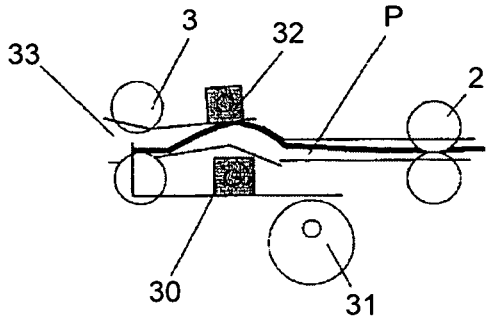
FIG. 5 is a schematic explanatory diagram of the operations to be performed by the skew correcting unit in the situation where skew correction is to be performed and illustrating a state where the leading edge of the sheet has abutted on the stopper plate.

FIG. 4 to FIG. 9 are schematic diagrams illustrating operations to be performed in a situation where skew correction is to be performed. In the situation where skew correction is to be performed, when the sheet P has been conveyed to the second conveying rollers 2, the third conveying rollers 3 are at a standby state where the third conveying rollers 3 are released from a pressure contact as illustrated in FIG. 4. When the sheet P is further conveyed and caused to abut on the stopper plate 30 by the second conveying rollers 2 as illustrated in FIG. 5, the sheet P is resiliently bent and hence subjected to skew correction.

Figure 6:
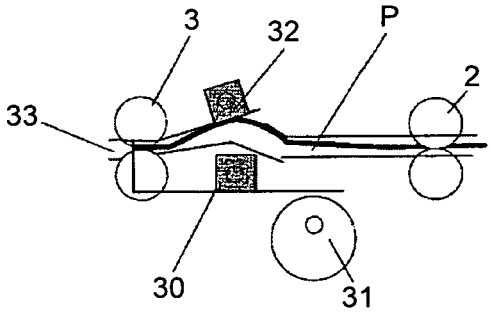
FIG. 6 is a schematic explanatory diagram of the operations to be performed by the skew correcting unit in the situation where skew correction is to be performed and illustrating a state where the leading edge of the sheet has abutted on the stopper plate and, after completion of skew correction, the third conveying rollers are pressing against each other.
Figure 7:
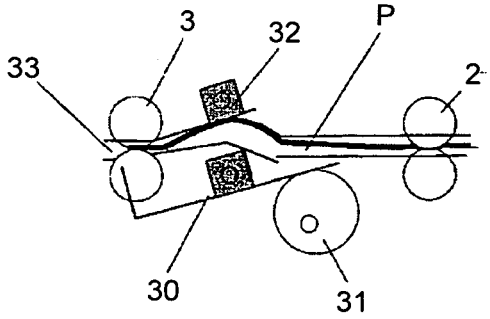
FIG. 7 is a schematic explanatory diagram of the operations to be performed by the skew correcting unit in the situation where skew correction is to be performed and illustrating a state, subsequent to the state of FIG. 6, where the stopper plate has retracted from a conveyance path.
Figure 8:
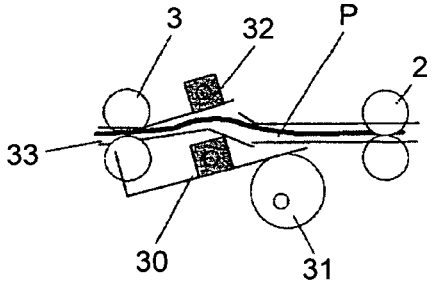
FIG. 8 is a schematic explanatory diagram of the operations to be performed by the skew correcting unit in the situation where skew correction is to be performed and illustrating a state, subsequent to the state of FIG. 7, where the sheet is being conveyed.
Figure 9:
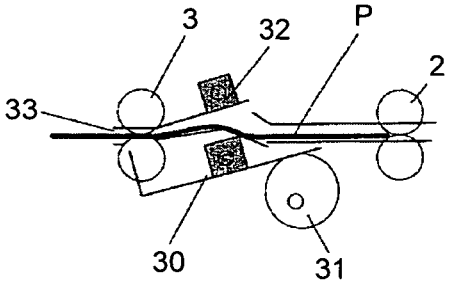
FIG. 9 is a schematic explanatory diagram of the operations to be performed by the skew correcting unit in the situation where skew correction is to be performed and illustrating a state, subsequent to the state of FIG. 8, where the resiliently-bent sheet is conveyed only by the third conveying rollers to thus be straightened.

After completion of the skew correction, the third conveying rollers 3 are brought into a pressure contact as illustrated in FIG. 6, causing the stopper plate 30 to retract from the conveyance path 33 as illustrated in FIG. 7. After the stopper plate 30 has been retracted, the sheet P is conveyed downstream by the second and the third conveying rollers 2 and 3 as illustrated in FIG. 8. After the sheet P has passed through the second conveying rollers 2, the sheet P is conveyed only by the third conveying rollers 3 as illustrated in FIG. 9, which straightens the resiliently-bent sheet P.

Meanwhile, the conveyance guide plate 32 is elevated and lowered following ascending and descending motions of one conveying roller, which is on the upper one in FIGS. 4 to 9, of the third conveying rollers 3, thereby opening and closing the conveyance path 33.

2) Operations after Skew Correction

After passing through the skew correcting unit E, the sheet P reaches the creasing unit C. The creasing unit C operates differently depending on whether creasing is to be performed.

2-1) Situation where Creasing is to be Skipped

Figure 12:
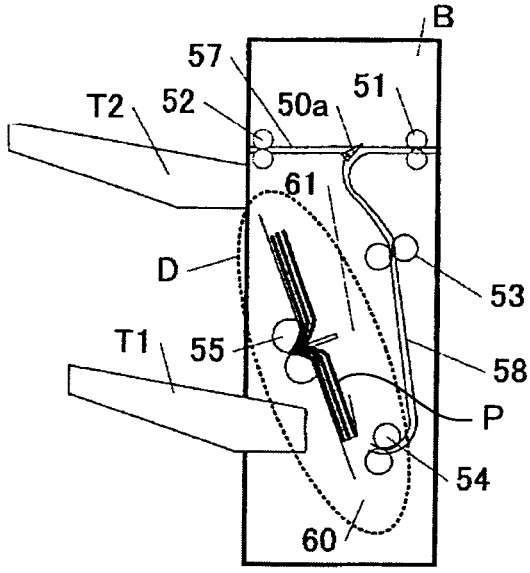
FIG. 12 is a schematic explanatory diagram of the operations to be performed in the situation where the folding device is to perform folding and illustrating a state where a sheet batch stacked on the processing tray is being center folded.
Figure 13:
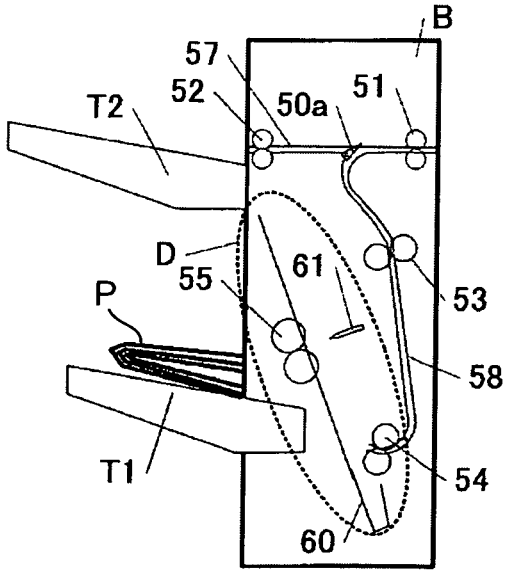
FIG. 13 is a schematic explanatory diagram of the operations to be performed in the situation where the folding device is to perform folding and illustrating a state where the center-folded sheet batch has been delivered onto a stacking tray.
Figure 14:
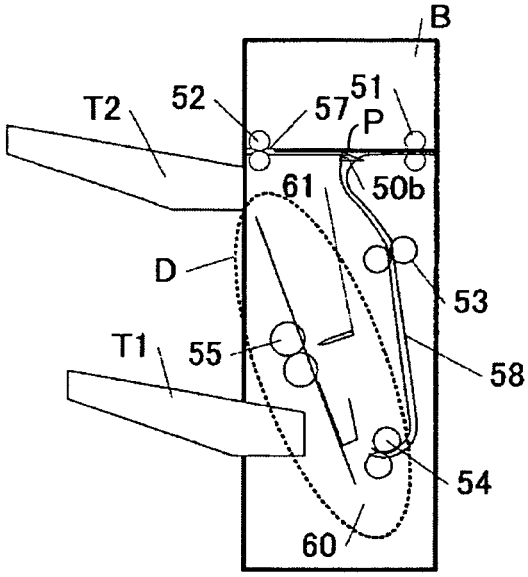
FIG. 14 is a schematic explanatory diagram of operations to be performed in a situation where the folding device is to skip folding and illustrating a state where a sheet is conveyed through a sheet-output conveyance path.
Figure 15:
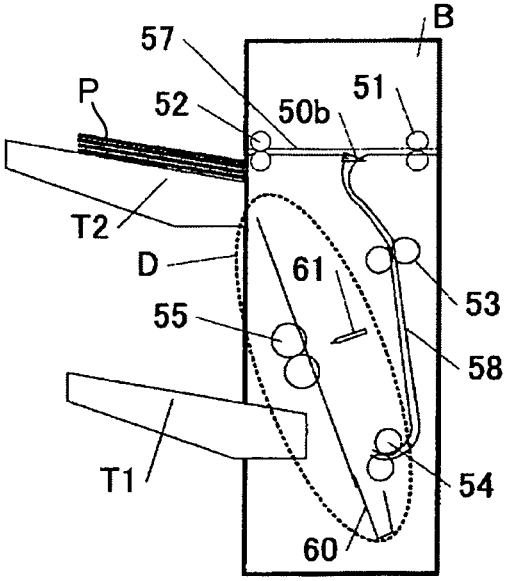
FIG. 15 is a schematic explanatory diagram of the operations to be performed in the situation where the folding device is to skip folding and illustrating a state where the sheet is delivered through the sheet-output conveyance path to a stacking tray and placed thereon.

FIG. 10 to FIG. 13 are schematic explanatory diagrams of operations in a situation where the folding device B performs folding. FIG. 14 and FIG. 15 are schematic diagrams illustrating operations in a situation where folding is skipped.

Figure 10:
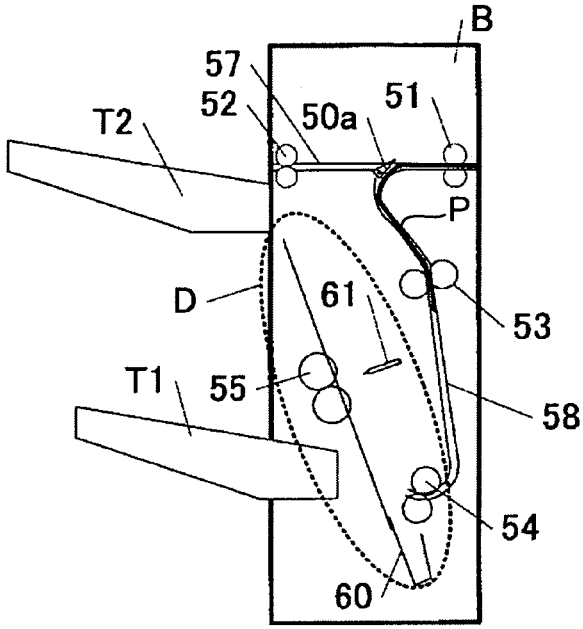
FIG. 10 is a schematic explanatory diagram of operations to be performed in a situation where a folding device is to perform folding and illustrating a state where a path-switching flap is actuated to guide a sheet to a processing conveyance path.

After passing through the skew correcting unit E, the sheet P is conveyed to the folding apparatus B by the fourth and the fifth conveying rollers 4 and 5. When the sheet P is to be conveyed to the folding apparatus B to undergo folding, the path-switching flap 50 is in a position 50*a* where the path-switching flap 50 closes the sheet-output conveyance path 57 but opens the processing conveyance path 58 as illustrated in FIG. 10. Hence, the sheet P is guided to the processing conveyance path 58 by the path-switching flap 50.

Figure 11:
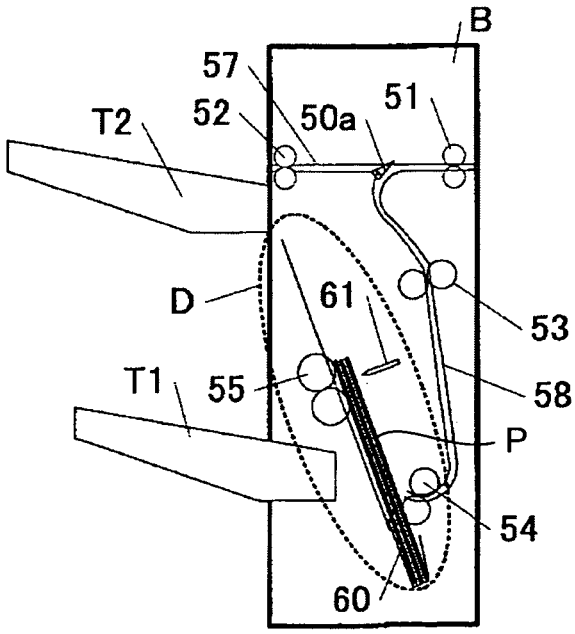
FIG. 11 is a schematic explanatory diagram of the operations to be performed in the situation where the folding device is to perform folding and illustrating a state where all sheets have been conveyed through the processing conveyance path and stacked on a processing tray.

Thereafter, the sheet P is conveyed to the folding unit D by the eighth and the ninth conveying rollers 53 and 54 and placed on the trailing-edge fence 60 as illustrated in FIG. 11. The placed sheet P is conveyed (lifted up) by the trailing-edge fence 60 to a folding position. The sheet P is pushed into a nip between the folding rollers 55 by the folding plate 61 as illustrated in FIG. 12, to thus be folded in the folding roller 55. Thereafter, the sheet P is delivered onto the stacking tray T1 as illustrated in FIG. 13.

In the situation where folding is to be skipped, the path-switching flap 50 is in a position 50*b* where the path-switching flap 50 opens the sheet-output conveyance path 57 but closes the processing conveyance path 58 as illustrated in FIG. 14. This causes the sheet P to be delivered through the sheet-output conveyance path 57 onto the stacking tray T2 by the seventh conveying rollers 52.

2-2) Situation where Creasing is to be Performed

To ensure creasing quality, it is preferable that skew correction is performed on every sheet that is to undergo creasing. Note that a configuration where a user can configure settings so as to skip skew correction can be employed.

Figure 16:
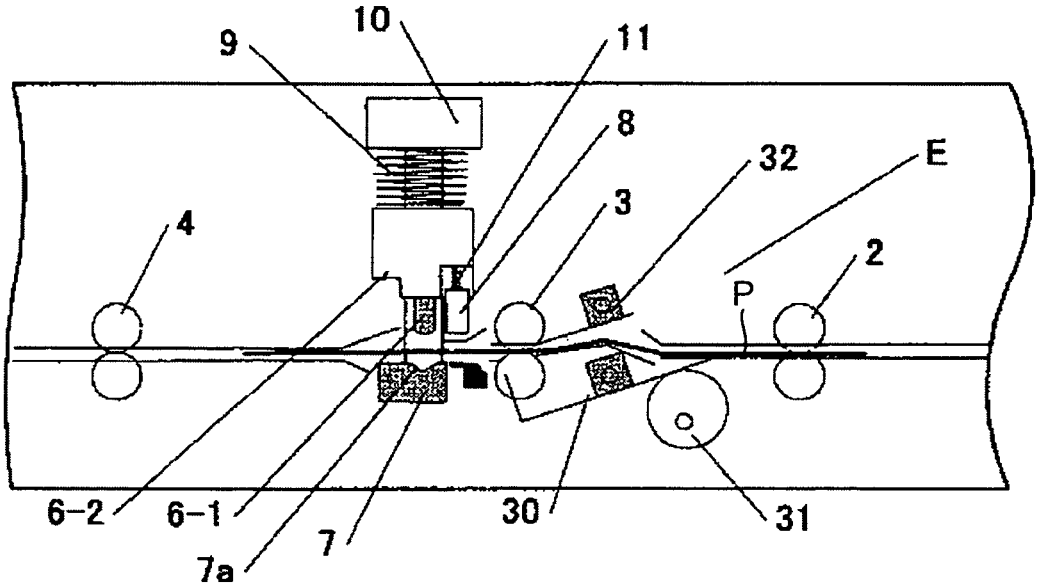
FIG. 16 is a schematic explanatory diagram of creasing operations and illustrating a state where a sheet having undergone skew correction is conveyed into a creasing unit by a specified distance.
Figure 17:
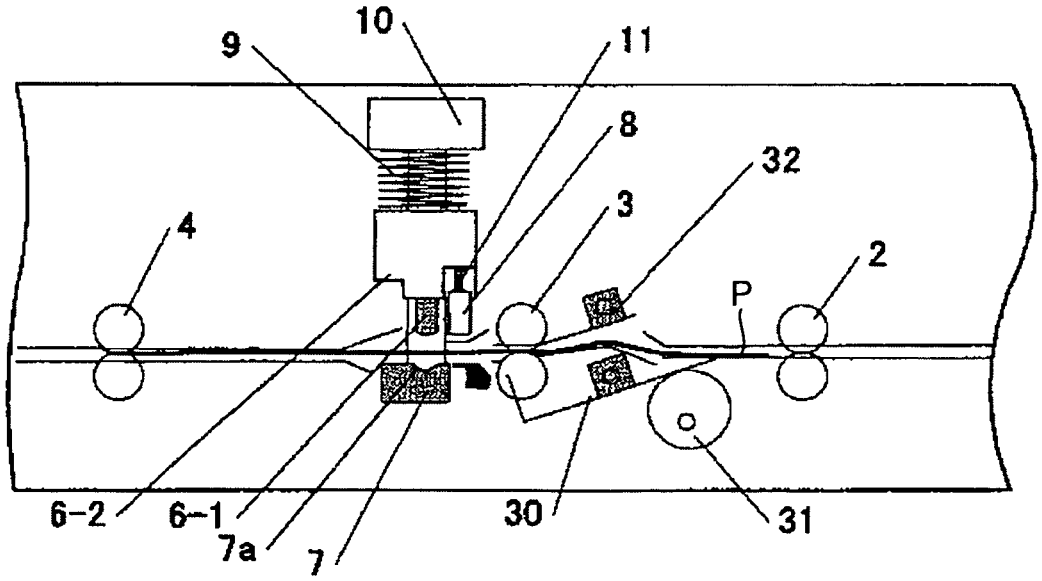
FIG. 17 is a schematic explanatory diagram of the creasing operations and illustrating a state where the sheet having undergone skew correction is conveyed to a creasing position and stopped.
Figure 18:
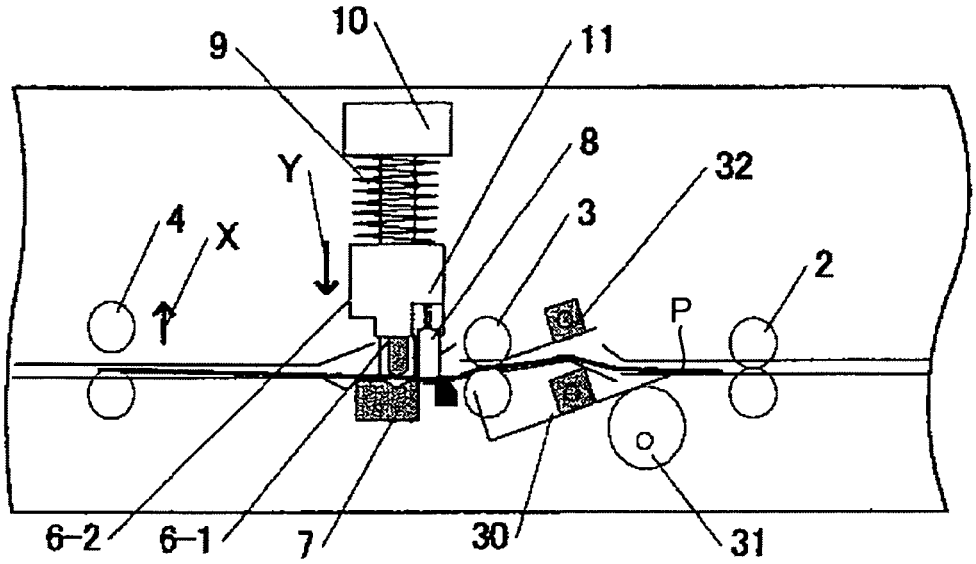
FIG. 18 is a schematic explanatory diagram of the creasing operations and illustrating a state where, after a sheet retainer has made a contact with the sheet stopped at the creasing position, fourth conveying rollers are released from a pressure contact.

FIG. 16 to FIG. 21 are schematic diagrams illustrating creasing operations. As illustrated in FIG. 16, after skew correction, the sheet P is conveyed into the creasing unit C by the third conveying rollers 3 by a specified distance with reference to the stopper plate 30. When the sheet P has been conveyed to a creasing position as illustrated in FIG. 17, the sheet P is stopped. When the sheet P is stopped, the creasing blade 6-1 is lowered in a direction indicated by arrow Y as illustrated in FIG. 18. After the sheet retaining member 8 has made a contact with the sheet P, an upper roller of the fourth conveying rollers 4 ascends as indicated by arrow X, releasing the fourth conveying rollers 4 from a pressure contact.

Figure 19:
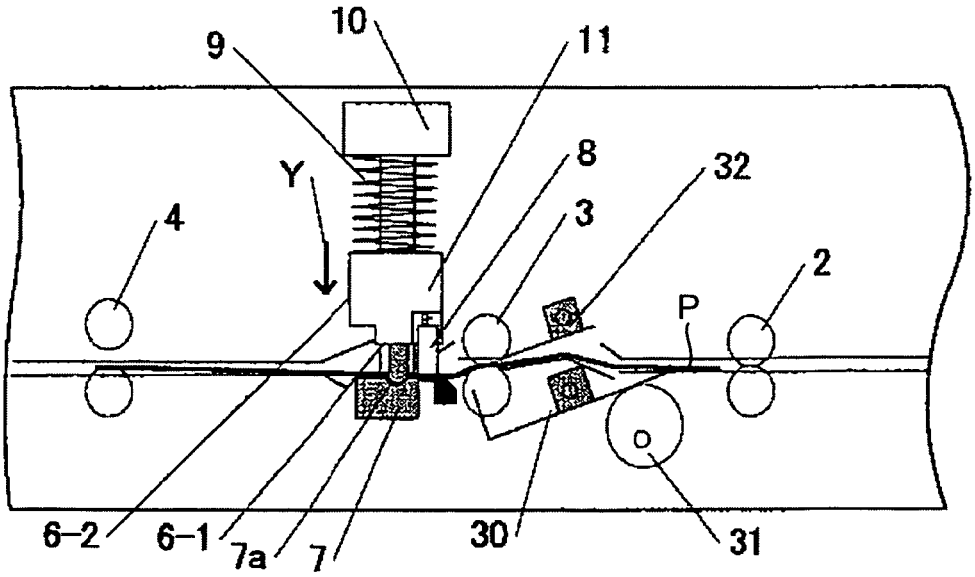
FIG. 19 is a schematic explanatory diagram of the creasing operations and illustrating a state where the sheet stopped at the creasing position is being creased.
Figure 20:
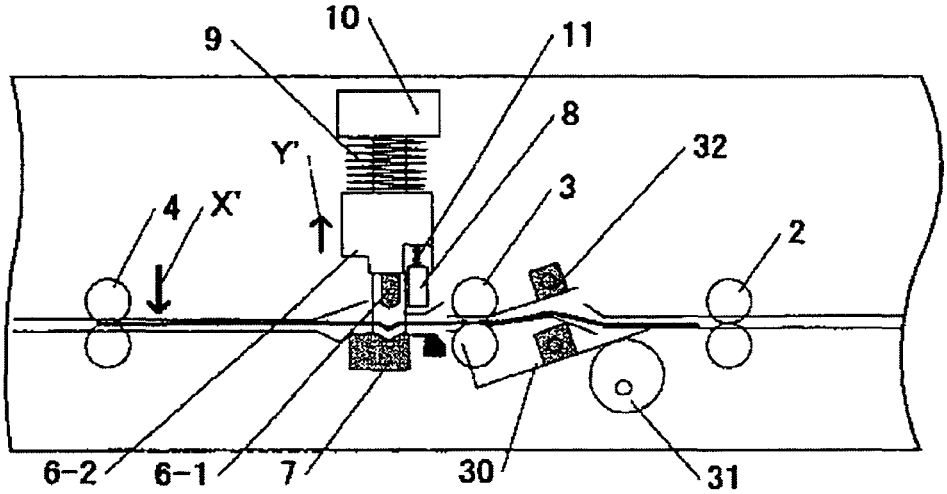
FIG. 20 is a schematic explanatory diagram of the creasing operations and illustrating a state where, after the sheet has stopped at the creasing position, a creasing member is moving away from the sheet.
Figure 21:
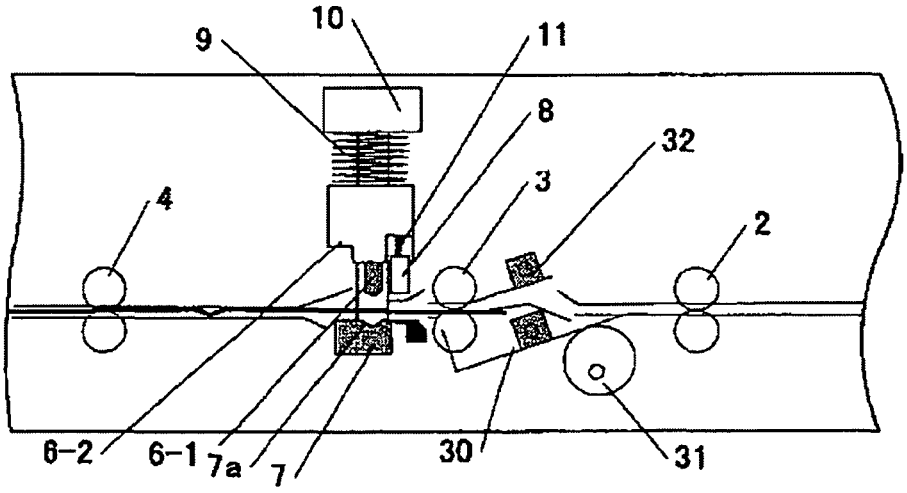
FIG. 21 is a schematic explanatory diagram of the creasing operations and illustrating a state where the creasing member has moved away from the sheet and sheet conveyance is started.

As illustrated in FIG. 19, after the fourth conveying rollers 4 have been released from the pressure contact, the creasing blade 6-1 further descends in the direction indicated by arrow Y to pinch the sheet P with a predetermined pressure between the creasing blade 6-1 and the receiving member 7. As a result, a crease is produced in the sheet P. After completion of creasing, as illustrated in FIG. 20, the creasing blade 6-1 ascends in a direction indicated by arrow Y'. Just when the creasing blade 6-1 departs from the sheet P, the fourth conveying rollers 4 descend in a direction indicated by arrow X' to press against the sheet P again, thereby placing the sheet P in a conveyable state. Thereafter, as illustrated in FIG. 21, the sheet P is conveyed downstream by the fourth conveying rollers 4.

When the sheet P has been conveyed to the folding device B, the operations discussed above with reference to FIG. 10 to FIG. 13 or FIG. 14 and FIG. 15 are performed as in the situation mentioned above in 2-1) where creasing is to be skipped.

Figure 22:
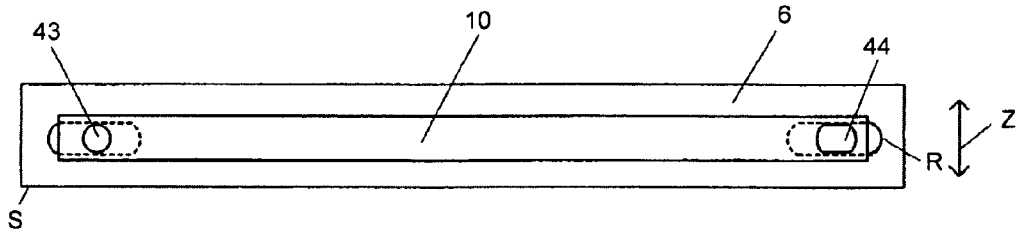
FIG. 22 is a plan view of a relevant portion of the creasing unit for illustration of its configuration.
Figure 23:
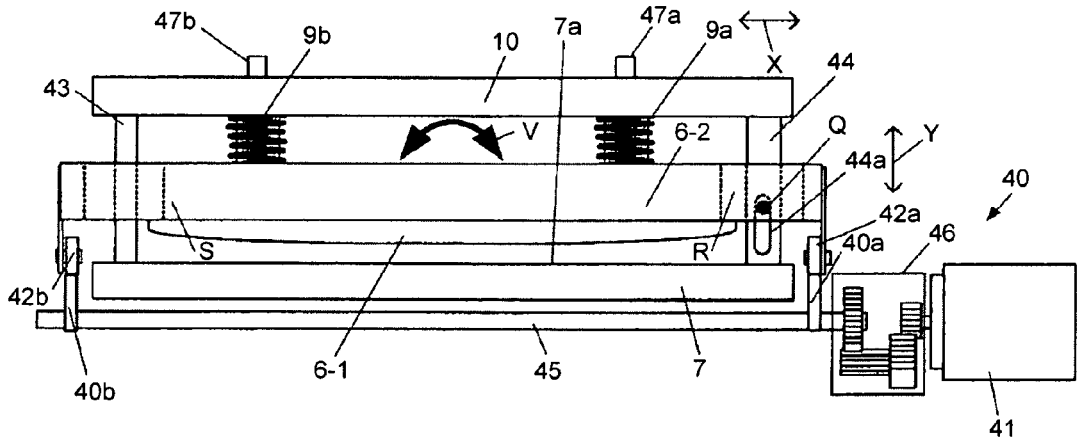
FIG. 23 is an elevation view of a relevant portion of the creasing unit for illustration of its configuration.

The configuration of the creasing unit C that performs the creasing operations mentioned above is illustrated in detail in FIG. 22, which is a plan view of a relevant portion of the creasing unit C, and in FIG. 23, which is an elevation view (elevation view corresponding to the plan view of FIG. 22). Referring to FIG. 22 and FIG. 23, the creasing unit C includes the creasing member 6 (the creasing blade 6-1 and the creasing support member 6-2), the receiving member 7, and the drive mechanism 40.

The creasing member 6 has, in addition to the creasing blade 6-1 provided at a lower end of the creasing member 6, a first elongated hole R and a second elongated hole and S, into which a first support shaft 44 and a second support shaft 43, which will be described later, are to be loosely fit, respectively, and includes a first positioning member 42*a* and a second positioning member 42*b* provided at a rear end portion and a front end portion, respectively. The first and the second elongated holes R and S are elongated in a direction perpendicular to the sheet conveying direction as indicated by arrow Z and configured to allow the first and the second support shafts 44 and 43 to pivot relative to a plane that lies perpendicularly to the sheet conveying direction but not to allow movement in the sheet conveying direction. The first and the second positioning members 42*a* and 42*b* extend substantially vertically downward from a front end portion and a rear end portion of the creasing support member 6-2. The first and the second positioning members 42*a* and 42*b* are disciform cam followers that are rotatably supported at their centers and brought into contact with the first cam 40*a* and the second cam 40*b* to be rotated. Meanwhile, a front side of the device is depicted on the left-hand side in FIG. 22 and FIG. 23.

The receiving member 7 is coupled to the resilient member fixing plate 10 located above the creasing member 6 via the first and the second support shafts 44 and 43 and moved integrally with the resilient member fixing plate 10. Provided on two longitudinal end portions of the resilient member fixing plate 10 are a first shaft member 47*a*, which is on a rear side, and a second shaft member 47*b*, which is on a front side. A first resilient member 9*a* and a second resilient member 9*b* (which are collectively referred to as "the resilient member 9") are mounted on an outer periphery of the first shaft member 47*a* and an outer periphery of the second shaft member 47*b*, respectively and constantly resiliently urging the resilient member fixing plate 10 upward, and hence the receiving member 7 upward. The first support shaft 44 having a semicircular cross-sectional profile taken along short sides in a rectangular cross section is loosely fit in the first elongated hole R. A third elongated hole 44*a* that is vertically elongated is defined in the first support shaft 44 at a portion lower than a mid-portion of the first support shaft 44. A rotating shaft Q is vertically (in a direction perpendicular to the plane of FIG. 23) inserted into the third elongated hole 44*a* from a side-surface side of the creasing member 6. The diameter, of the rotating shaft Q is set to such a dimension, relative to the width of the third elongated hole 44*a*, that allows the rotating shaft Q to move in Y-directions in FIG. 23 but prevents the same from moving in X-directions. This allows the first support shaft 44 to rotate about the rotating shaft Q and move in the longitudinal direction of the third elongated hole 44*a*. These configurations mentioned above allow pivoting motion as indicated by arrow V in FIG. 23.

The drive mechanism 40 is a mechanism that rotates the cams 40*a* and 40*b*, which are in contact with the positioning members 42*a* and 42*b*, to press the creasing member 6 against the receiving member 7 and move the creasing member 6 away from the receiving member 7. The drive mechanism 40 includes a camshaft 45, to which the first cam 40*a* and the second cam 40*b* are coaxially coupled at a rear portion and a front portion of the camshaft 45, respectively, a drive gear train 46, through which the camshaft 45 is driven, at an end portion (in the present embodiment, a rear end portion) of the camshaft 45, and a drive motor 41 that drives the drive gear train 46. The first cam 40*a* and the second cam 40*b* are located to face the first positioning member 42*a* and the second positioning member 42*b* and abutting thereon, respectively. The cams 40*a* and 40*b* move the creasing member 6 toward and away from the receiving member 7 according to a distance between the positioning members 42*a* and 42*b* on a straight line passing through a center of the camshaft 45 and a rotation center of the positioning members 42*a* and 42*b*. At this time, a range where the creasing member 6 moves is confined by each of the first and the second support shafts 44 and 43 and the first and the second elongated channels R and S. The creasing member 6 reciprocates under this confined state. A configuration that causes the creasing blade 6-1 of the creasing member 6 to come into contact with the receiving member 7 in an orientation inclined relative to the receiving member 7 rather than parallel with the receiving member 7 so that the creasing blade 6-1 oriented obliquely relative to a plane of the sheet produces a crease in the sheet according to shapes of the first and the second cams 40*a* and 40*b* is employed. A distal-end edge face of the creasing blade 6-1 is arcuate as illustrated in FIG. 23.

FIG. 24 to FIG. 29 are schematic illustrations of operations performed to crease (score) a sheet by using the creasing member 6. Creasing starts when the drive motor 41 starts running in response to an instruction fed from a control circuit (not shown).

Figure 24:
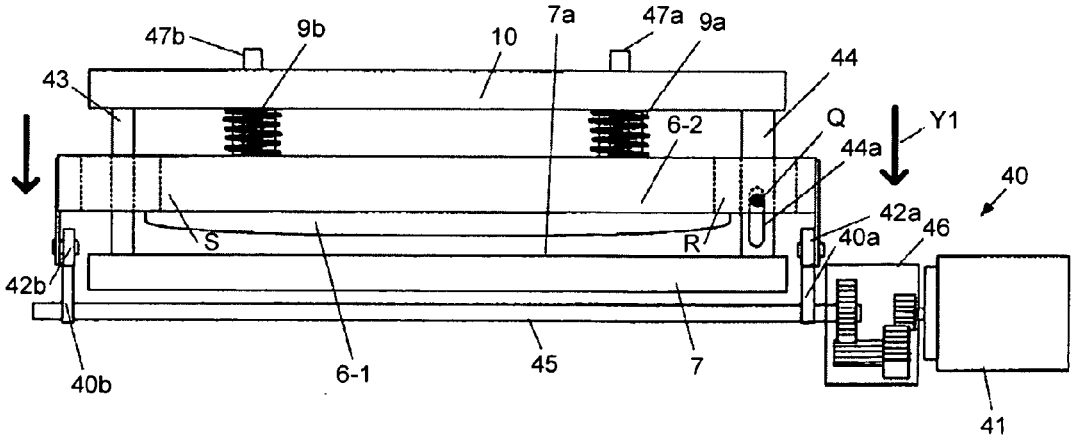
FIG. 24 is a schematic explanatory diagram of operations performed to crease a sheet by using the creasing member and illustrating an initial position where the creasing member is positioned uppermost.

More specifically, when the drive motor 41 starts rotating from the state (where a sheet has been conveyed to and stopped at the creasing position), which corresponds to an initial position, illustrated in FIG. 24, the camshaft 45 is rotated via the drive gear train 46, which in turn rotates the first and the second cams 40*a* and 40*b*. As the first and the second cams 40*a* and 40*b* rotate, the first and the second positioning members 42*a* and 42*b*, which are the cam followers that abut on the first and the second cams 40*a* and 40*b* and roll, are rotated, causing a center distance between the positioning members 42*a* and 42*b*, and the camshaft 45 to change, thereby moving the creasing member 6 in a direction indicated by Y1.

Figure 25:
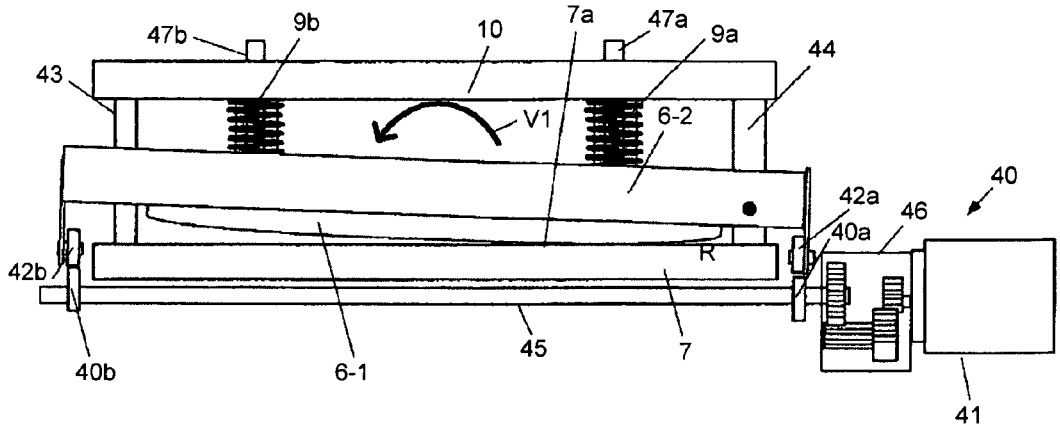
FIG. 25 is a schematic explanatory diagram of the operations performed to crease the sheet by using the creasing member and illustrating a state where a creasing blade has abutted on a creasing channel.

When the creasing blade 6-1*a* abuts on the creasing channel 7*a* of the receiving member 7 as illustrated in FIG. 25, the receiving member 7 prevents the creasing member 6 from moving farther. When the drive motor 41 further rotates from this state, the first positioning member 42*a* and the first cam 42*a* are separated from each other. At this time, the second positioning member 42*b* is in contact with the second cam 40*b* because a front portion, relative to the device, of the creasing blade 6-1 of the creasing member 6 is not abutting on the receiving member 7. An abutting position where the creasing blade 6-1 abuts on the creasing channel 7*a* of the receiving member 7 is out of a range where sheets are conveyed; accordingly, as the abutting position changes after the creasing blade 6-1 has abutted on the creasing channel 7*a*, a sheet comes to be interposed between the creasing blade 6-1 and the creasing channel 7*a* that are in contact.

Figure 26:
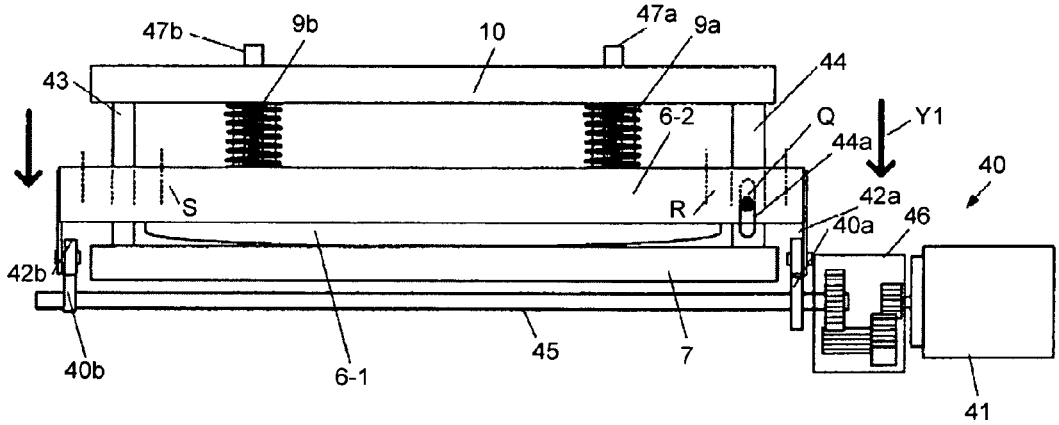
FIG. 26 is a schematic explanatory diagram of the operations performed to crease the sheet by using the creasing member and illustrating a state where the creasing blade has abutted on the creasing channel to perform creasing.

When the drive motor 41 further rotates from the state illustrated in FIG. 25, the front portion, relative to the device, of the creasing blade 6-1 is also brought into contact with the creasing channel 7*a* of the receiving member 7 as shown in FIG. 26. Accordingly, resilient forces of the first and the second resilient members 9*a* and 9*b* apply a pressure onto the sheet P, forming a crease in the sheet P.

Figure 27:
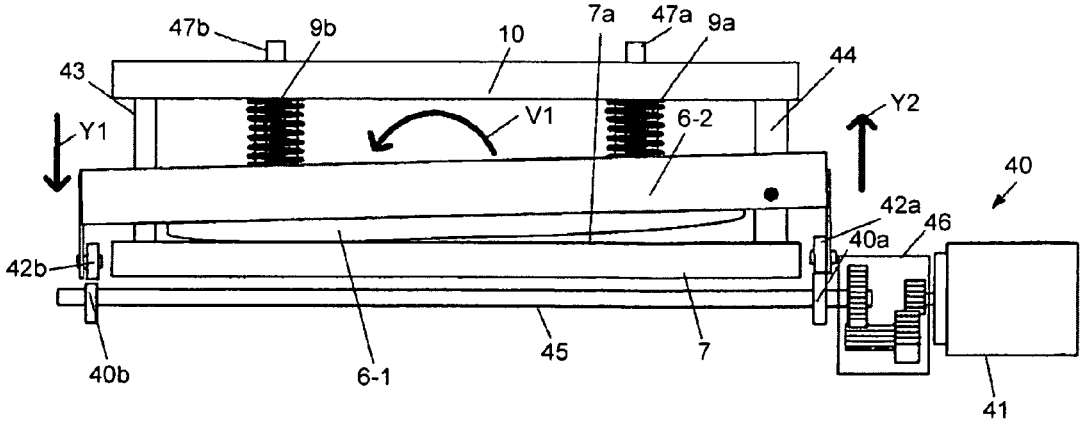
FIG. 27 is a schematic explanatory diagram of the operations performed to crease the sheet by using the creasing member and illustrating a state where an abutting position, at which the creasing blade abuts on the creasing channel, has moved toward a front side of the device, causing the abutting position to depart from the sheet.
Figure 28:
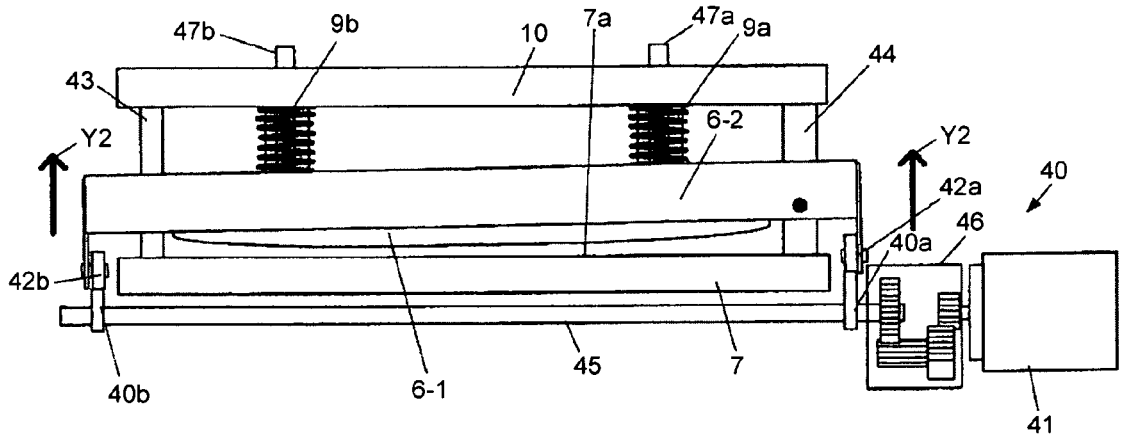
FIG. 28 is a schematic explanatory diagram of the operations performed to crease the sheet by using the creasing member, and illustrating a state where the creasing blade has departed from a receiving member.

After the crease has been formed, the drive motor 41 further rotates, causing the camshaft 45 and the first and the second cams 40*a* and 40*b* to rotate. As illustrated in FIG. 27, the first positioning member 42*a* and the first cam 40*a* are brought into contact with each other earlier than the second positioning member 42*b* and the second cam 40*b*, and the first cam 40*a* pushes up the first positioning member 42*a* on a far side, moving up a far-side portion of the creasing member 6 in a direction indicated by an arrow Y2 earlier than a near-side portion of the creasing member 6. As illustrated in FIG. 28, when a bottom end of the creasing blade 6-1, which is on the far side, or, put another way, on the side of the first positioning member 42*a*, is separated from the receiving member 7, the second positioning member 42*b* and the second cam 40*b* on the front side relative to the device come into contact with each other, and a face of the creasing member 6 on the side of the second positioning member 42*b* also ascends in the direction indicated by the arrow Y2.

Figure 29:
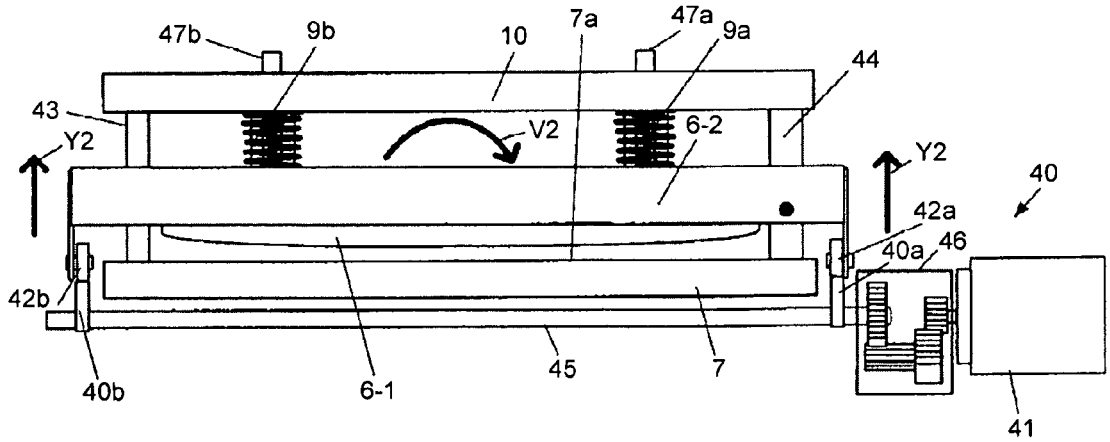
FIG. 29 is a schematic explanatory diagram of the operations performed to crease the sheet by using the creasing member and illustrating a state where, after the departure from the receiving member, the creasing member pivots toward an opposite side to return to an initial state.

The bottom end of the creasing blade 6-1 on the side of the first positioning member 42*a* is temporarily stopped at the position separated from the receiving member 7. When a top surface of the creasing member 6 is oriented horizontally as illustrated in FIG. 29, the creasing member 6 ascends while maintaining the horizontal orientation to return to a standby position, or, put another way, the initial position illustrated in FIG. 25. At the initial position, the creasing blade 6-1 is inclined such that the far side of the creasing blade 6-1 is closer to the receiving member 7 than the front side is.

In this process, as illustrated in FIG. 25, after the far side, relative to the device, of the creasing blade 6-1 has abutted on the receiving member 7, the creasing blade 6-1 rotates counterclockwise (indicated by an arrow V1) in FIG. 25. After both sides of the creasing member 6 have ascended in the direction indicated by the arrow Y2 in FIG. 19, the creasing member 6 pivots clockwise (in the direction indicated by an arrow V2) in FIG. 29. The creasing member 6 is thus constructed to have what is called a pivot center at its distal end and to produce a crease with an arcuate blade (the creasing blade 6-1) that pivots about the far side relative to the device by going through a motion similar to that of a cutter that performs cutting with a pressure exerted thereon. This motion is produced by the shapes of the first and the second cams 40*a* and 40*b*.

FIG. 30A to FIG. 30E are schematic illustrations of operations and illustrating how positional relationship between the receiving member 7 and the creasing member 6 changes as positional relationship between the first and the second cams 40*a* and 40*b* and the first and the second positioning members 42*a* and 42*b* changes. In FIG. 30A to FIG. 30E, relationships between rotational positions of the first cam 40*a* and those of the first positioning member 42*a* on the far side relative to the device are depicted on the right-hand side; relationships between rotational positions of the second cam 40*b* and those of the second positioning member 42*b* on the front side relative to the device are depicted on the left-hand side. Positional relationships between the creasing channel 7*a* of the receiving member 7 and the creasing blade 6-1 of the creasing member 6 that depend on rotations of the first and the second cams 40*a* and 40*b* are depicted at portions between the right-hand side and the left-hand side.

Figures 30A, 30B, 30C, 30D, 30E:
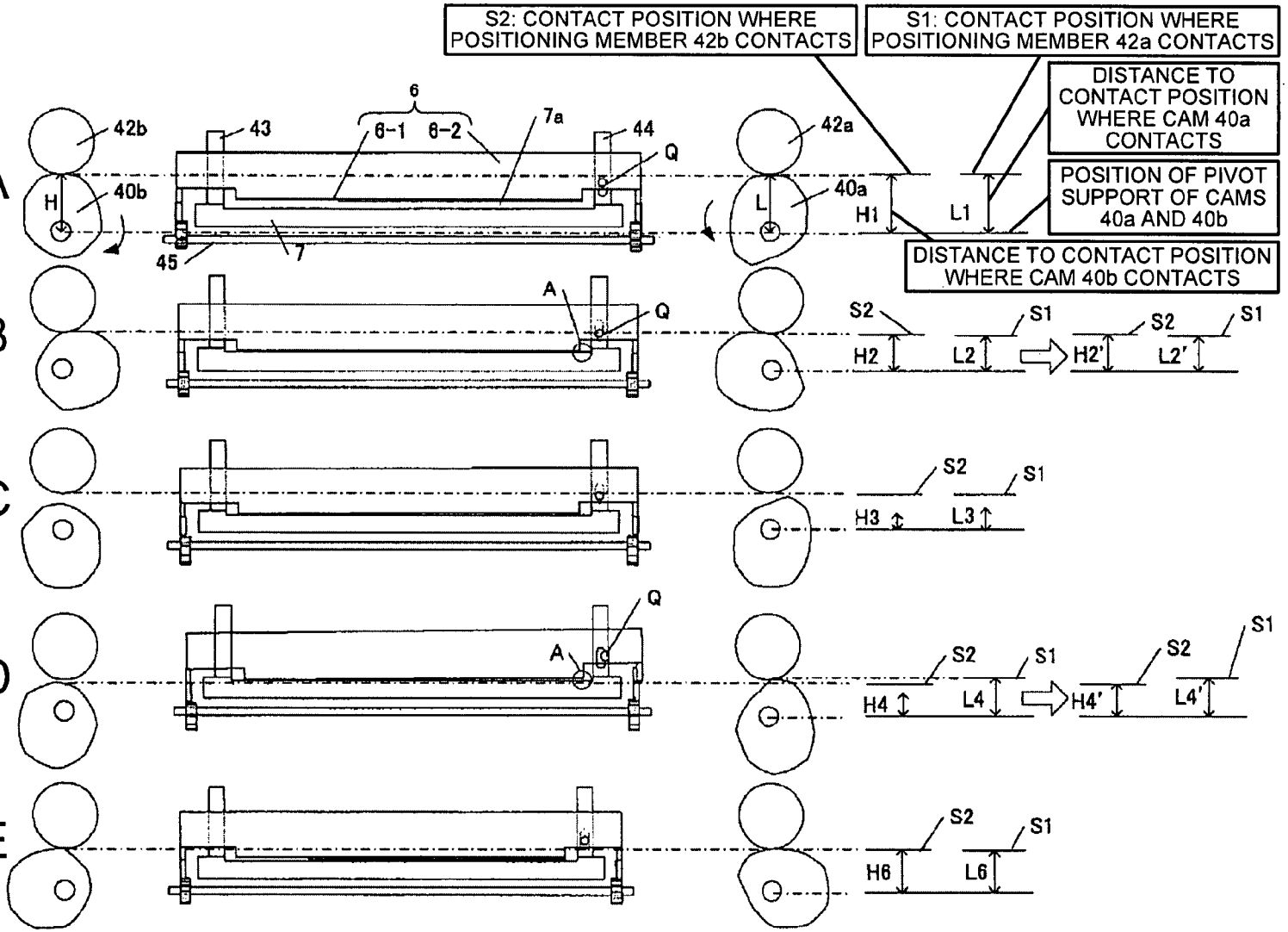
FIGS. 30A to 30E are schematic explanatory diagram of operations and illustrating how positional relationship between the receiving member and the creasing member changes as positional relationship between cams and positioning members changes.

FIG. 30A illustrates a position of the creasing blade 6-1 relative to the receiving member 7 in a period where a sheet has been conveyed into the creasing device A, conveyed to a folding position, and stopped at the folding position. This position is the initial position. In FIG. 30A to FIG. 30E, L denotes the distance from the center of the camshaft 45 of the first cam 40*a* to a point of contact (on an outer peripheral surface) between the first positioning member 42*a* and the first cam 40*a* on a straight line passing through the center of the camshaft 45 of the first cam 40*a* and the center of the rotating shaft of the first positioning member 42*a*. H denotes the distance from the center of the camshaft 45 of the second cam 40*b* to a point of contact (on an outer peripheral surface) between the second positioning member 42*b* and the second cam 40*b* on a straight line passing through the center of the camshaft 45 of the second cam 40*b* and the center of the second positioning member 42*b*.

When, in FIG. 30A, a contact position between the first cam 40*a* and the first positioning member 42*a* is denoted by S1 and a contact position between the second cam 40*b* and the second positioning member 42*b* is denoted by S2, relationships among the contact position S1, the distance L1, the contact position S2, and the distance H1 can be expressed by the following equations.

$$S1=L1$$

$$S2=H1$$

$$H1=L1$$

In this state, the creasing blade 6-1 and the creasing channel 7*a* are in the positional relationship illustrated in FIG. 24, where a clearance between the creasing blade 6-1 and the creasing channel 7*a* on the far side and that on the front side are equal to each other. Meanwhile, H is the distance to the point of contact of between the second cam 40*b* and a corresponding one of the cam followers; L is the distance to the point of contact of between the first cam 40*a* and a corresponding one of the cam followers.

FIG. 30B illustrates relevant elements in a state where a portion A, which is a trailing-edge portion of the creasing blade 6-1, has come into contact with the receiving member 7. The portion A is located farther outside than an edge of a sheet of a maximum size in the present embodiment. A front portion of the creasing blade 6-1 descends as pivoting about an outer portion (rear portion) of the portion A. A relationship between the distance H2 and the distance L2 for a period from a start of the operation until the portion A of the creasing blade 6-1 comes into contact with the receiving member 7 can be expressed by the following equation.

$$H2=L2$$

Accordingly, a front-side portion and a rear-side portion of the creasing blade 6-1 move (descend) by the same distance concurrently. FIG. 25 illustrates this positional relationship.

In a state where the first and the second cams 40*a* and 40*b* are further rotated after the portion A has come into contact with the receiving member 7, as illustrated in FIG. 30B, relationships between the contact position S1 and the distance L2', and the contact position S2 and the distance H2' can be expressed by the following expressions.

$$S1>L2'$$

$$S2=H2'$$

In this process, the creasing member 6 rotates about the pivot support Q.

FIG. 30C illustrates a position in a state where the creasing member 6 has pivoted about the pivot support Q and a blade face of the creasing blade 6-1 has come into contact with the creasing channel 7*a* of the receiving member 7. As illustrated in FIG. 30C, relationships between the contact position S1 and the distance L3, and the contact position S2 and the distance H3 at a time of this contact can be expressed by the following expressions.

$$S1>L3$$

$$S2>H3$$

The distance is smaller than the contact position at each side of the creasing blade 6-1. Hence, the first and the second resilient members 9*a* and 9*b* press the creasing member 6, causing the creasing blade 6-1 to be fitted into the creasing channel 7*a* of the receiving member 7 with a sheet therebetween, thereby producing a crease in the sheet. FIG. 26 illustrates the positional relationship.

FIG. 30D illustrates a position in a state where the portion A of the creasing blade 6-1 separates from the receiving member 7. Relationships between the contact position S1 and the distance L4, and the contact position S2 and the distance H4 at this separation can be expressed by the following expressions.

$$S1=L4$$

$$S2>H4$$

Thereafter, the positional relationships shift to positional relationships that can be expressed by the following equations.

$$S1=L4'$$

$$S2=H4'$$

FIG. 27 illustrates the positional relationships.

Meanwhile, the contact position S1 on the rear side is at a rest until the contact position S2 on the front side reaches the contact position on the rear side. As shown in FIG. 30E, after a relationship expressed by S1=S2 has been established, the creasing blade 6-1 returns to the standby position illustrated in FIG. 30A.

The shapes of the first and second cams 40*a* and 40*b* are configured such that a speed, at which the creasing blade 6-1 moves away from the receiving member 7, increases after the creasing blade 6-1 starts moving away as illustrated FIG. 30D. In FIG. 30A to 30E, the creasing blade 6-1 is illustrating as having a linear shape; however, this is because FIG. 30A to 30E are scaled down by a large scale factor due to a circumstance related to making of the drawings and it is difficult to distinguish intersecting lines near the distal-end edge of the creasing blade 6-1. As illustrated in FIG. 23 to FIG. 29, the creasing blade 6-1 has an arcuate shape protruding downward in an actual structure. Furthermore, the creasing blade 6-1 is preferably configured to come into contact with the creasing channel 7*a* at a low speed at an instant when a contact therebetween is made, and after the contact, moved at a high speed. This drive control can be implemented by using the shapes of the cams or by performing motor control.

By performing the operations mentioned above, sheets P are creased on a sheet-by-sheet basis and then conveyed into the folding device B.

The creasing blade 6-1 of the creasing unit C is an arcuate blade as discussed above. The blade of the receiving member 7, or, put another way, the creasing channel 7*a*, paired with the creasing blade 6-1 can be one of three types, or, more specifically, a parallel blade, a convex blade, or a concave blade. Example combinations of these blades are discussed below with reference to FIG. 31A to FIG. 37.

Figure 31A:
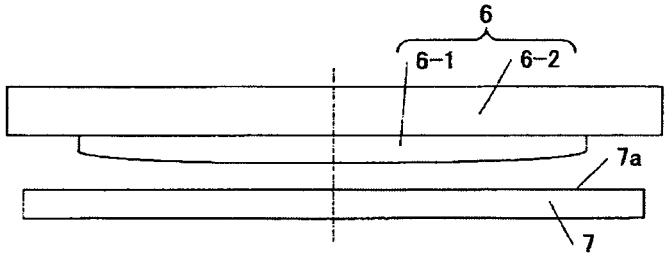
FIGS. 31A and 31B are schematic diagrams illustrating an example combination of the creasing blade, which is an arcuate convex blade, and the creasing channel, which is a parallel blade, and their operations.
Figure 31B:
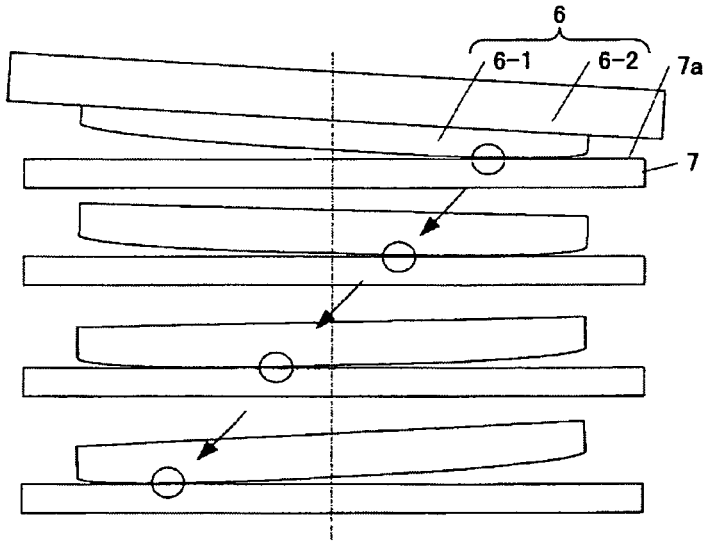

FIGS. 31A and 31B are diagrams illustrating an example combination of the creasing blade 6-1, which is an arcuate convex blade, and the creasing channel 7*a*, which is a parallel blade. FIG. 31A is an elevation view. FIG. 31B is a diagram illustrating operations of elements of FIG. 31A.

FIG. 31A illustrates operations of the blades that perform creasing. As indicated by a hollow circle in FIG. 31B, the creasing blade (male blade) 6-1 and the creasing channel 7*a* make a point-to-point contact. When creasing is performed with blades, each of which is a parallel blade, the blades make an area-to-area contact. Accordingly, a disadvantageous state that some portion of a sheet is pressed while the other portion is not pressed due to distortion of a blade and/or nonuniform thickness of the sheet or a state that a pressure is applied by a blade across a wide contact area, causing a pressure applied by some portion (particularly a longitudinal center portion) of the blade to be weak and producing a nonuniform crease, can occur. In contrast, using the arcuate blade allows a point-to-point contact to be made at every position on a contact line. Accordingly, a uniform crease can be produced with application of a relatively low pressure. Furthermore, placing an overload on members can be circumvented because, with this configuration, creasing can be performed with the relatively low pressure. This allows the creasing blade 6-1 and the creasing channel 7*a* to have longer usable lives. Furthermore, a blade-against-blade contact can be made gradually and smoothly by starting the contact from an end portion of the blade. Accordingly, a noise made by the blade-against-blade contact is reduced as compared with that of a configuration using parallel blades.

FIG. 31A and FIG. 31B illustrate an arrangement where the arcuate blade is on a driving side while the parallel blade is on a fixed side; alternatively, another arrangement where the parallel blade is on the driving side while the arcuate blade is on the fixed side can be employed. Relative relationship stands between them, and each arrangement can yield a similar effect.

Figure 32A:
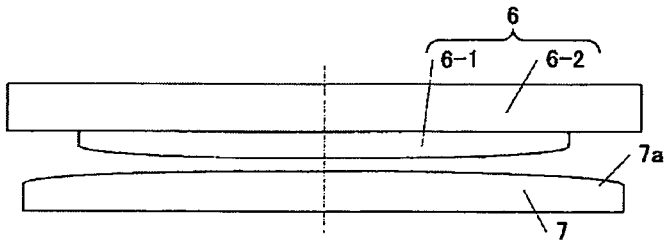
FIGS. 32A and 32B are diagrams illustrating an example combination of the creasing blade, which is an arcuate convex blade, and the creasing channel, which is a female blade including a convex edge portion, and their operations.
Figure 32B:
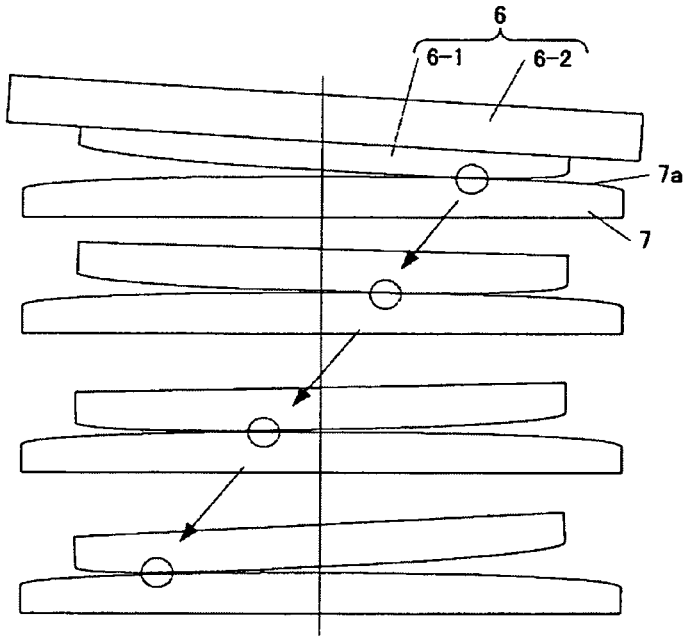

FIGS. 32A and 32B are diagrams illustrating an example combination of the creasing blade 6-1, which is an arcuate convex blade, and the creasing channel 7*a*, which is a female blade including a convex edge portion. FIG. 32A is an elevation view. FIG. 32B is a diagram illustrating operations of elements of FIG. 32A.

When each of the creasing blade 6-1 and the creasing channel 7*a* has a convex shape as illustrated in FIG. 32A, a contact point indicated by a hollow circle is smaller than that of FIG. 31B. This allows a uniform crease to be produced with application of a still lower pressure. This configuration can yield a larger effect against the disadvantage of a configuration using parallel blades that a pressure applied to a center portion in the conveying direction is likely to be weak.

Figure 33A:
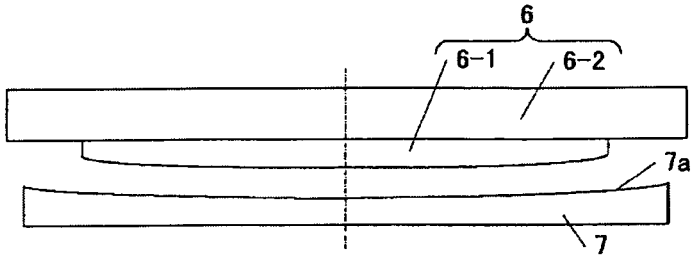
FIGS. 33A and 33B are diagrams illustrating an example combination of the creasing blade, which is an arcuate concave blade, and the creasing channel, which is a female blade including a concave edge portion, and their operations.
Figure 33B:
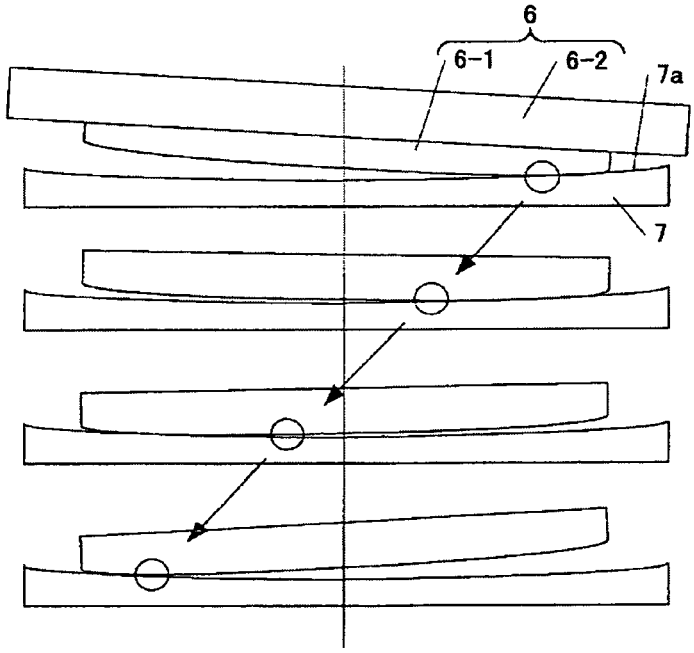

FIGS. 33A and 33B are diagrams illustrating an example combination of the creasing blade 6-1, which is an arcuate convex blade, and the creasing channel 7*a*, which is a female blade including a concave edge portion. FIG. 33A is an elevation view. FIG. 33B is a diagram illustrating operations of elements of FIG. 33A.

Referring to FIGS. 33A and 33B, a radius of the arc of the receiving member 7 is preferably greater than a radius of the arc of the creasing blade 6-1. More specifically, an absolute value of a curvature of the creasing blade 6-1 is greater than an absolute value of a curvature of the creasing channel 7*a*. The curvatures of the creasing blade 6-1 and the creasing channel 7*a* are of opposite sign. When the creasing channel 7*a* and the creasing blade 6-1 are configured to have such a relative relationship as mentioned above, a blade-against-blade contact can be made smoother than that in the examples of FIGS. 31A and 31B and FIGS. 32A and 32B. Accordingly, not only a uniform crease can be produced but also contact noise can be reduced.

Figure 34:
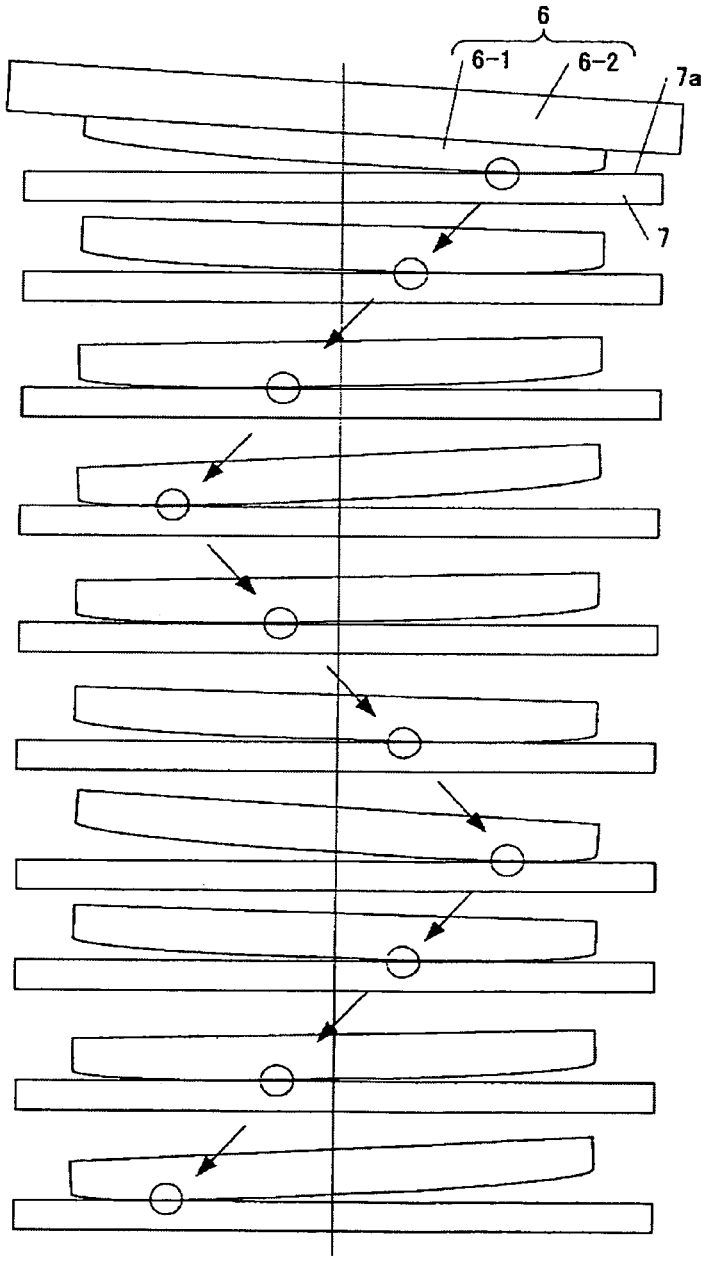
FIG. 34 is a diagram illustrating an example combination of the creasing blade, which is the arcuate convex blade, and the creasing channel, which is the parallel blade, and their operations in a situation where across a sheet is creased with a plurality of creasing strokes.

FIG. 34 is a diagram illustrating operations in a situation where a crease is produced with a plurality of creasing strokes by using the combination illustrated in FIGS. 31A and 31B.

Also in the example illustrated in FIG. 34, a contact point is indicated by a hollow circle. Indicated in FIG. 34 is that a crease is produced with a plurality of creasing strokes, pivoting motion of the creasing blade 6-1 during creasing causes the hollow circle representing the contact position to reciprocate. Producing a crease with a plurality of creasing strokes in this manner allows smooth creasing, causing a decrease in productivity less likely to occur than that by using parallel blades.

Figure 35:
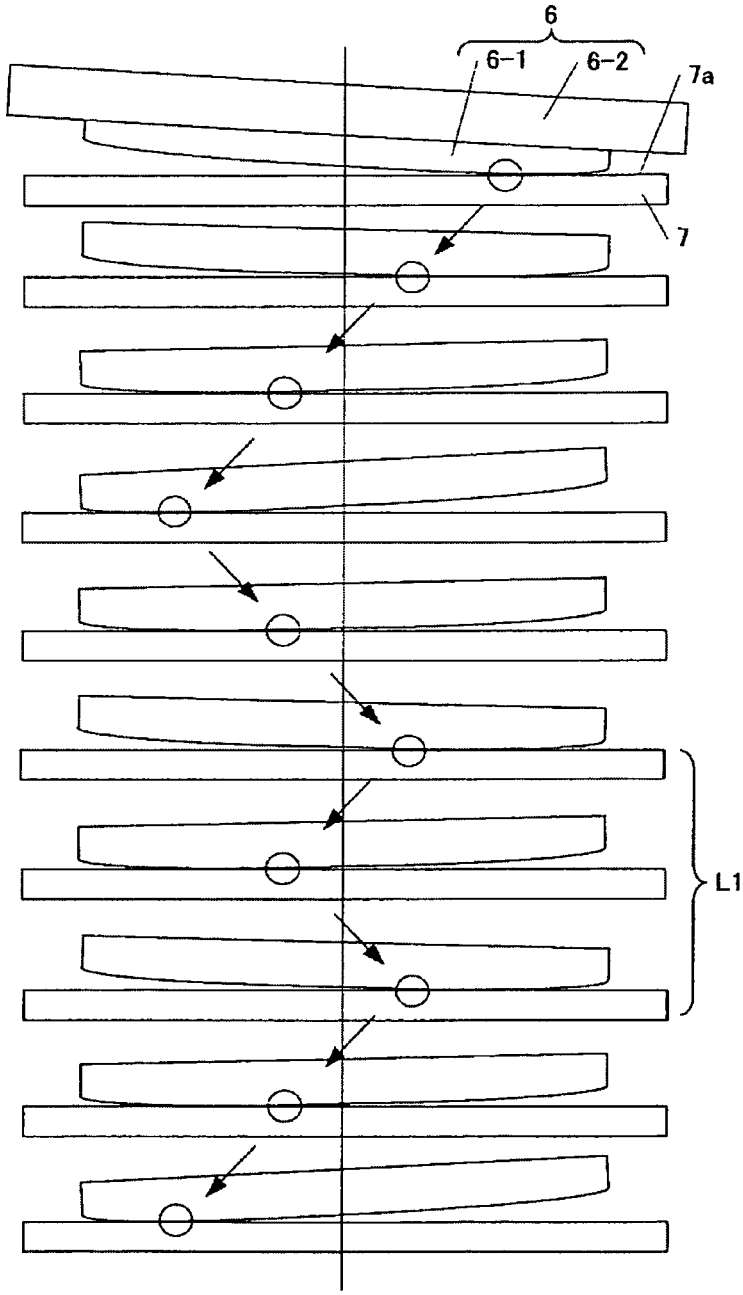
FIG. 35 is a diagram illustrating an example combination of the creasing blade, which is the arcuate convex blade, and the creasing channel, which is the parallel blade, and their operations in a situation where a center portion is creased with a plurality of creasing strokes.

FIG. 35 also illustrates an example where a crease is produced with a plurality of creasing strokes as with the example discussed above. In this example, the creasing blade 6-1, which is arcuate, makes a point-to-point contact with the creasing channel 7*a*. Accordingly, a desired portion of a crease can be creased sharply. In the example illustrated in FIG. 35, an area, indicated by L1, where a hollow circle moves is creased sharply.

Figure 36:
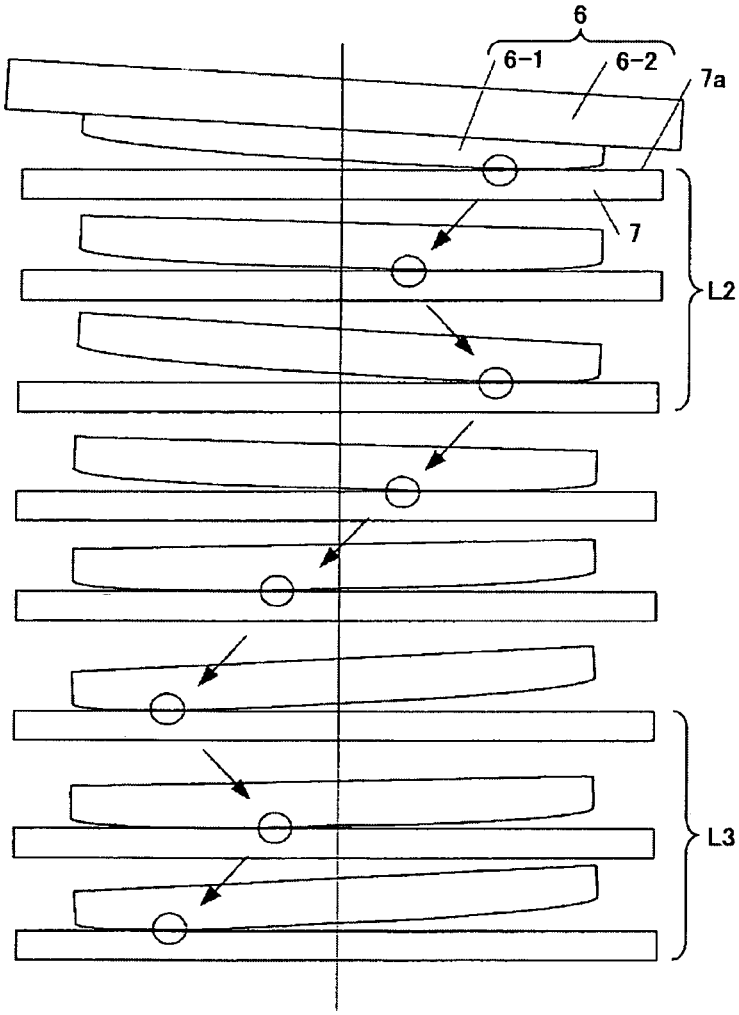
FIG. 36 is a diagram illustrating an example combination of the creasing blade, which is the arcuate convex blade, and the creasing channel, which is the parallel blade, and their operations in a situation where two end potions of a sheet is creased with a plurality of creasing strokes.
Figure 37:
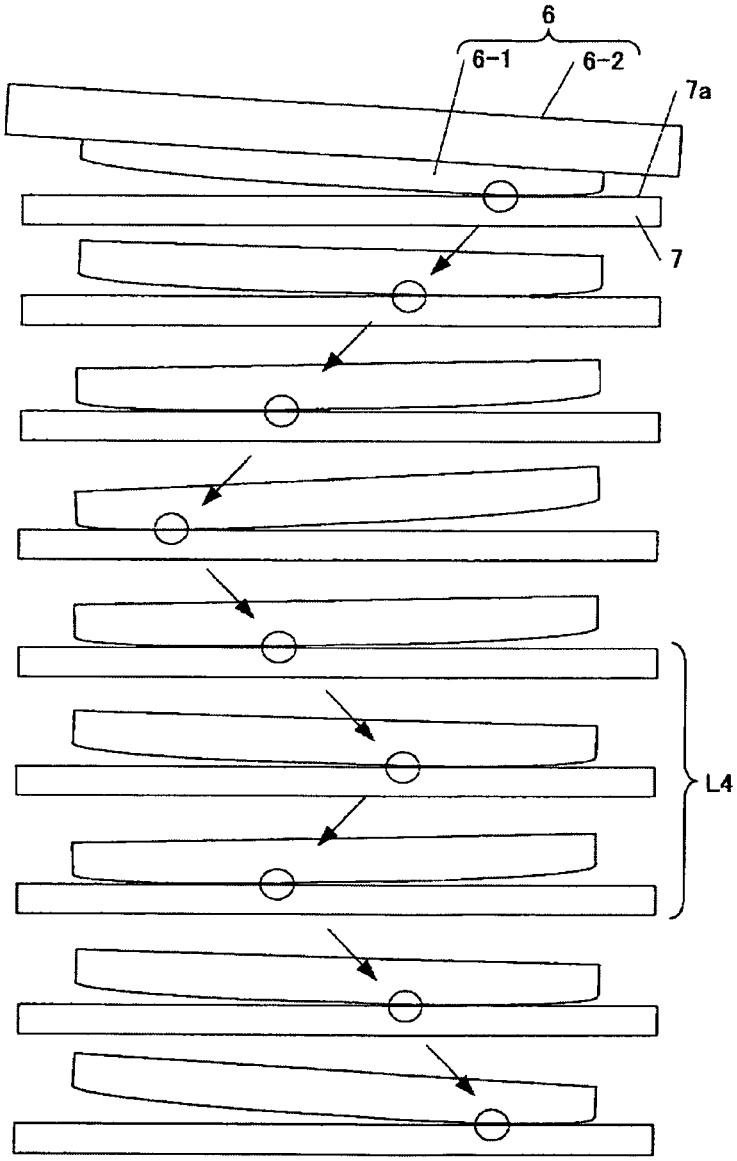
FIG. 37 is a diagram illustrating an example combination of the creasing blade, which is the arcuate convex blade, and the creasing channel, which is the parallel blade, and their operations in a situation where a desired portion of a sheet is creased with a plurality of creasing strokes.

FIG. 36 illustrates an example where areas, which are two end portions and indicated by L2 and L3, where a hollow circle moves are creased sharply. FIG. 37 illustrates an example where an area, which is a desired area near a center portion and indicated by L4, where a hollow circle moves is creased sharply. In these examples, the areas indicated by L3, L3, and L4 are each creased more frequently than the other areas are.

The thicker the paper is, the less readily a crease is produced in the paper. When a sheet to be creased is of a large size, a center portion of the sheet is less readily creased because a pressure applied to the center portion is likely to be weak. In consideration of these, a creasing-blade contact duration is set to any one of t1, t2, and t3, and a creasing-stroke count is preferably set to any one of u1, u2, and u3 depending on results of determinations related to r1, which is a predetermined sheet thickness, s1, which is a predetermined sheet size, and whether the sheet is special paper. The creasing-blade contact durations t1, t2, and t3 and the creasing-stroke counts u1, u2, and u3 are to be determined in advance. For a sheet to be creased with a plurality of creasing strokes, it is preferable that determination as to whether additional creasing position is a center portion of the sheet or two end portions of the sheet can be made.

Figure 38:
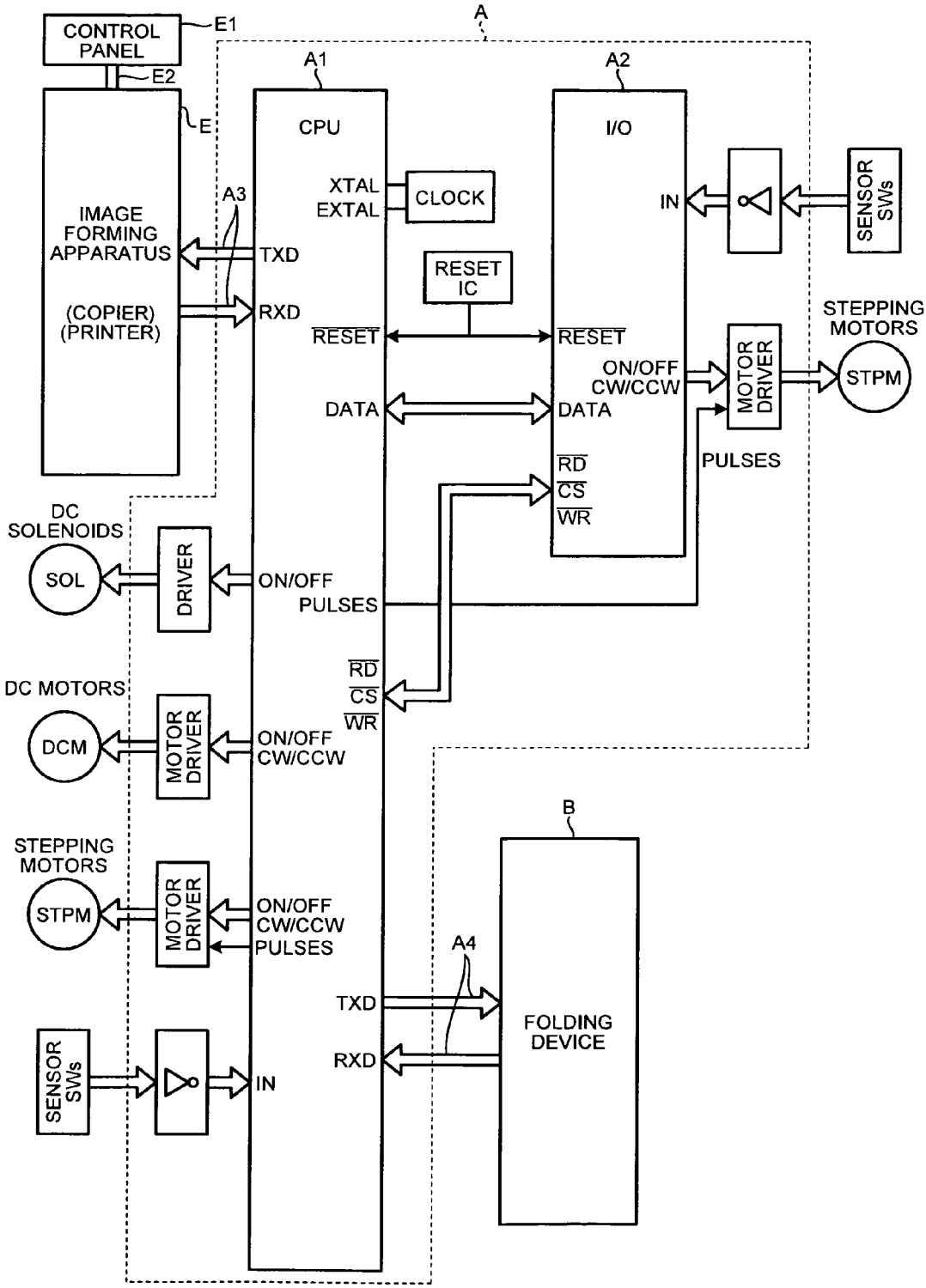
FIG. 38 is a block diagram illustrating a control structure of the image forming system including the creasing device, the folding device, and an image forming apparatus.

FIG. 38 is a block diagram illustrating a control structure of the image forming system including the creasing device A, the folding device B that performs folding, and the image forming apparatus E. The creasing device A includes a control circuit equipped with a microcomputer including a central processing unit (CPU) A1 and an input/output (I/O) interface A2. Various signals are fed to the CPU A1 via a communications interface A3 from the CPU, various switches on a control panel E1, and various sensors (not shown) of the image forming apparatus E. The CPU A1 performs predetermined control operations based on a thus-fed signal. The CPU A1 receives signals similar to those mentioned above from the folding device B via a communications interface A4 and performs predetermined control operations based on a thus-fed signal. The CPU A1 also performs drive control for solenoids and motors via drivers and motor drivers and obtains detection information from sensors in the device via the interface. The CPU A1 also performs drive control for motors via the I/O interface A2 and via motor drivers according to an entity to be controlled and sensors and obtains detection information from sensors. The CPU A1 performs the control operations discussed above by reading program codes stored in read only memory (ROM) (not shown), storing the program codes into random access memory (RAM) (not shown), and executing program instructions defined in the program codes by using the RAM as a working area and data buffer.

The creasing device A illustrated in FIG. 38 is controlled according to an instruction or information fed from the CPU of the image forming apparatus E. An operating instruction is input by a user from the control panel E1 of the image forming apparatus E. The image forming apparatus E and the control panel E1 are connected to each other via a communications interface E2. Accordingly, an operation signal input from the control panel E1 is transmitted from the image forming apparatus E to the creasing device A and to the folding device B. Operation status and functions of the devices A and B are indicated on the control panel E1 for a user.

Figure 39:
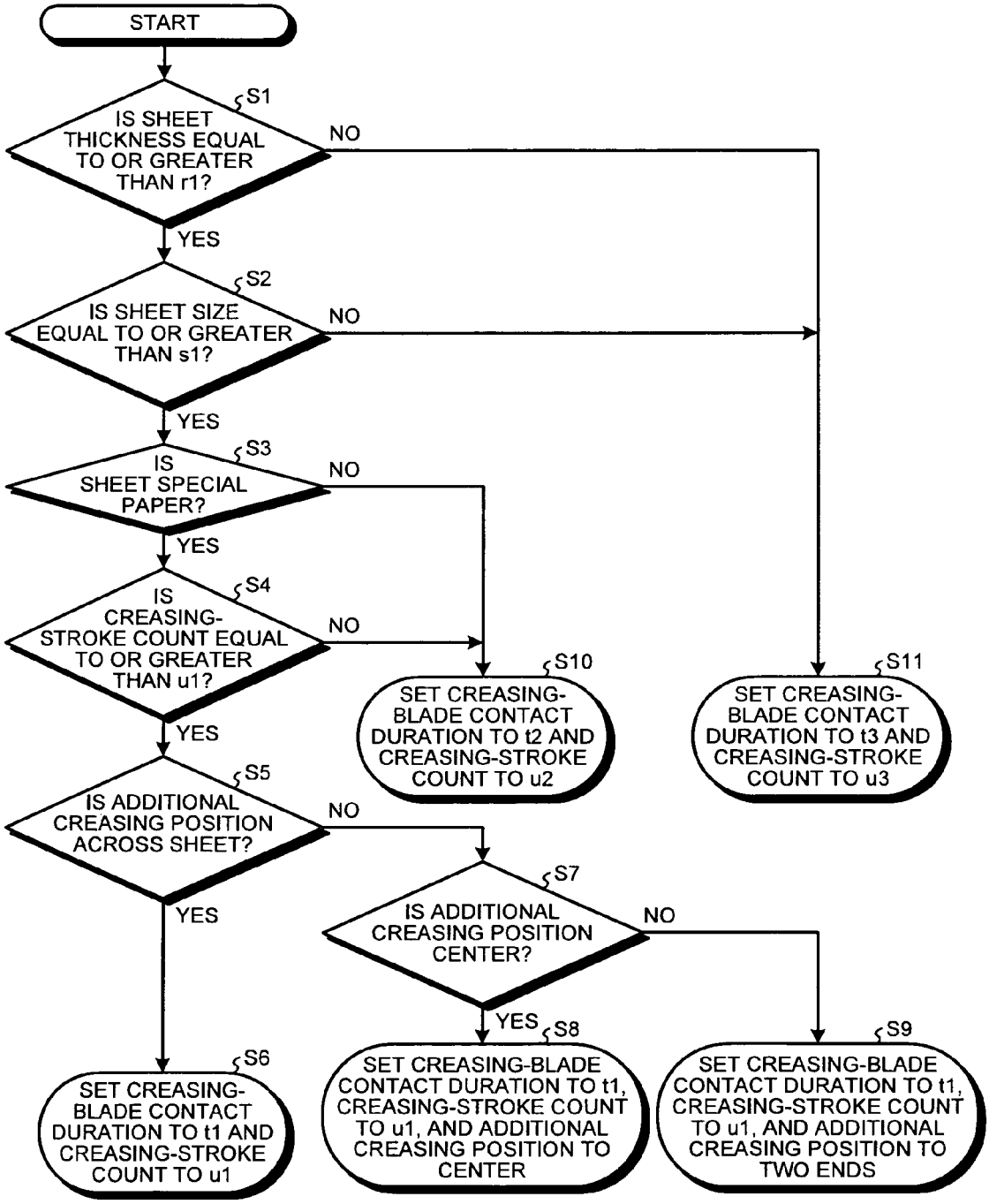
FIG. 39 is a flowchart for a procedure of control operations to be performed to determine a blade contact duration and a creasing-stroke count for creasing.

FIG. 39 is a flowchart for operations to be performed by the CPU A1 of the creasing device A to determine a creasing-blade contact duration and a creasing-stroke count.

In this control procedure for creasing, each of a determination related to a thickness of a sheet (STEP S1), a determination related to a sheet size (STEP S2), a determination as to whether the sheet is special paper or ordinary paper (STEP S3), a determination related to a creasing-stroke count (STEP S4), and a determination as to whether an additional creasing position is across the sheet (STEP S5) is made. If results of the determinations at STEP S1 to STEP S5 are all YES, or, more specifically, the thickness of the sheet is equal to or greater than r1, the sheet size is equal to or greater than s1, the sheet is special paper, the creasing-stroke count is equal to or greater than u1, and the additional creasing position is across the sheet, creasing (for instance, operations illustrated in FIG. 34) is performed with the creasing-blade contact duration set to t1 and the creasing-stroke count set to u1 (STEP S6):

If the additional creasing position is not across the sheet at STEP S5, whether the additional creasing position is a center portion or end portions is determined at STEP S7. If the additional creasing position is the center portion, creasing (for instance, operations illustrated in FIG. 35) including the additional creasing on the center portion is performed with the creasing-blade contact duration set to t1 and the creasing-stroke count set to u1 at STEP S8. If the additional creasing position is the end portions, creasing (for instance, operations illustrated in FIG. 36) including the additional creasing on the two end portions is, performed with the creasing-blade contact duration set to t1 and the creasing-stroke count set to u1 at STEP S9.

If it is determined that the sheet is normal paper at STEP S3 or if the creasing-stroke count is smaller than u1 at STEP S4, process control proceeds to STEP S10 where creasing is performed with the creasing-blade contact duration set to t2 and the creasing-stroke count set to u2. If it is determined that the sheet thickness is smaller than r1 at STEP S1 or if the sheet size is smaller than s1 at STEP S2, process control proceeds to STEP S11 where creasing is performed with the creasing-blade contact duration set to t3 and the creasing-stroke count set to u3.

As discussed above, when, as in the conventional technique, a creasing blade (male blade) and a creasing channel (female blade) are configured as parallel blades and a distal end portion of the parallel creasing blade comes into contact with the creasing channel across a width of the creasing blade, an area where a pressure is applied by the creasing blade is wide. For such a situation, the pressure to be applied by the creasing blade should preferably be high, which results in application of a large load during creasing. Put another way, unless a large load is applied, a sufficient crease cannot be produced. Meanwhile, a uniform crease is not always produced because the male blade, the female blade, and a sheet to be creased are not always in perfect-parallel alignment.

In contrast, according to the present embodiment, effects including the following are yielded.

1) The creasing blade 6-1 is an arcuate convex blade protruding relative to the creasing channel 7*a*. Accordingly, the creasing blade 6-1 can make a point-to-point contact with the creasing channel 7*a* at any position therein.
2) This allows a uniform crease to be produced in a sheet.
3) The point-to-point contact causes a load to be concentrated, which allows easy creasing.
4) The point-to-point contact causes a load to be concentrated, which allows creasing with a low load, thereby reducing a driving load for creasing.
5) Noise caused by creasing can be reduced because creasing can be performed with a low load.
6) It is no more necessary to perform creasing by making a contact a plurality of times because creasing can be performed by application of a concentrated low load. This increases productivity.
7) Supplemental creasing can be performed on a specified desired portion, such as a center portion or two end portions, in a single crease because a position where a point contact is to be made is controllable.

In the present embodiment, the creasing blade 6-1 has the arcuate shape; however, relative relationship stands between the shapes of the creasing blade 6-1 and the creasing channel 7*a*. The creasing channel 7*a* can have an arcuate shape protruding relative to the creasing blade 6-1 in inverse of the embodiment discussed above.

It should be understood that the present invention is not limited to the embodiments discussed above, and it is intended to cover all various modifications as may be included within the spirit and scope as set forth in the appended claims.

According to an aspect of the present invention, one member of a first member and a second member includes an arcuate edge make a point-to-point contact with a sheet therebetween. This allows reduction in processing time and production of a uniform crease in the sheet.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A creasing device for creasing sheets on a per-sheet basis, the creasing device comprising:

a first member extending in a direction perpendicular to a sheet conveying direction and including a male blade, the male blade having a convex cross section;

a second member extending in the direction perpendicular to the sheet conveying direction and including a grooved female blade, the female blade allowing the male blade to be fitted thereinto with a sheet between the female blade and the male blade; and a drive unit that brings the first member and the second member relatively into and out of contact with each other to cause a sheet stopped at a set position to be pinched between the first member and the second member and creased, wherein an edge portion of the female blade of the second member has a convex arcuate shape.

2. The creasing device according to claim 1, wherein an edge portion of the first member, on a side where the male blade is provided, has an arcuate shape protruding relative to the edge portion of the female blade of the second member.

3. The creasing device according to claim 1, wherein a position where the first member and the second member come into contact with each other is out of an area where any one of sheets of all applicable sizes passes through.

4. The creasing device according to claim 1, further comprising a control unit, wherein the control unit causes the drive unit to run at a low speed at an instant when an edge portion of the first member and an edge portion of the second member come into contact with each other and, after the contact, at a high speed.

5. The creasing device according to claim 1, further comprising a control unit, wherein the control unit determines a contact duration, over which the first member and the second member are to be in contact with each other, and a creasing-stroke count according to a paper type of the sheet, a thickness of the sheet, and a size of the sheet, and the control unit causes the drive unit to run according to the contact duration and the creasing-stroke count.

6. The creasing device according to claim 1, wherein the drive unit is configured to switch a driving direction at a desired position, to perform a creasing action a plurality of times on a desired area in an area to be creased for production of a sharply-creased portion.

7. An image forming system, comprising:

a creasing device; and an image forming apparatus for forming an image on a sheet member, wherein the creasing device includes:

a first member extending in a direction perpendicular to a sheet conveying direction and including a male blade, the male blade having a convex cross section;

a second member extending in the direction perpendicular to the sheet conveying direction and including a grooved female blade, the female blade allowing the male blade to be fitted thereinto with a sheet between the female blade and the male blade; and a drive unit that brings the first member and the second member relatively into and out of contact with each other to cause a sheet stopped at a set position to be pinched between the first member and the second member and creased, wherein an edge portion of the female blade of the second member has a convex arcuate shape.

8. A creasing device for creasing sheets on a per-sheet basis, the creasing device comprising:

a first member extending in a direction perpendicular to a sheet conveying direction and including a male blade, the male blade having a convex cross section;

a second member extending in the direction perpendicular to the sheet conveying direction and including a grooved female blade, the female blade allowing the male blade to be fitted thereinto with a sheet between the female blade and the male blade; and a drive unit that brings the first member and the second member relatively into and out of contact with each other to cause a sheet stopped at a set position to be pinched between the first member and the second member and creased, wherein an edge portion of the female blade of the second member has a concave arcuate shape.

* * * * *